US009331414B2

(12) United States Patent
Doi et al.

(10) Patent No.: US 9,331,414 B2
(45) Date of Patent: May 3, 2016

(54) ELECTRICAL CONNECTOR

(71) Applicant: Hirose Electric Co., Ltd., Tokyo (JP)

(72) Inventors: Kentaro Doi, Tokyo (JP); Akihiro Edashige, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/452,564

(22) Filed: Aug. 6, 2014

(65) Prior Publication Data

US 2015/0044901 A1 Feb. 12, 2015

(30) Foreign Application Priority Data

Aug. 9, 2013 (JP) ..... 2013-166099

(51) Int. Cl.

| | |
|---|---|
| ***H01R 13/631*** | (2006.01) |
| ***H01R 13/24*** | (2006.01) |
| ***H01R 12/65*** | (2011.01) |
| ***H01R 12/71*** | (2011.01) |
| ***H01R 13/41*** | (2006.01) |
| *H01R 12/73* | (2011.01) |

(52) U.S. Cl.

CPC ..... *H01R 13/24* (2013.01); *H01R 12/65* (2013.01); *H01R 12/716* (2013.01); *H01R 13/41* (2013.01); *H01R 13/6315* (2013.01); *H01R 12/737* (2013.01)

(58) Field of Classification Search

CPC ..... H01R 13/6315; H01R 13/631; H01R 13/2442

See application file for complete search history.

(56) References Cited

U.S. PATENT DOCUMENTS

| | | | | |
|---|---|---|---|---|
| 4,334,732 | A * | 6/1982 | Roeschlein et al. | 439/248 |
| 4,738,631 | A * | 4/1988 | Takahashi et al. | 439/248 |
| 5,201,663 | A * | 4/1993 | Kikuchi et al. | 439/83 |
| 5,306,169 | A * | 4/1994 | Fukushima et al. | 439/248 |
| 6,755,691 | B2 * | 6/2004 | Sasame et al. | 439/607.27 |
| 7,186,126 | B2 * | 3/2007 | Umehara et al. | 439/247 |
| 2002/0061671 | A1 * | 5/2002 | Torii | 439/247 |
| 2007/0202729 | A1 * | 8/2007 | Uesaka | 439/248 |
| 2007/0270009 | A1 * | 11/2007 | Schneider Nee Hild et al. | 439/248 |

FOREIGN PATENT DOCUMENTS

| | | | |
|---|---|---|---|
| JP | 2007-324028 | A | 12/2007 |
| JP | 2008-084756 | A | 4/2008 |
| JP | 2008-300130 | A | 12/2008 |
| JP | 2012-129109 | A | 7/2012 |

* cited by examiner

*Primary Examiner* — Gary Paumen
(74) *Attorney, Agent, or Firm* — Kubotera & Associates, LLC

(57) ABSTRACT

An electrical connector is to be connected to a mating side connector. The electrical connector includes a fixed housing to be fixed to a board; a movable housing arranged to be movable relative to the fixed housing; and a plurality of terminals disposed between the fixed housing and the movable housing. The terminal includes a connecting portion held with the fixed housing; a first elastic portion connected to the connecting portion; a terminal portion held with the movable housing; a second elastic portion connected to the terminal portion; and a wide width portion connected between the first elastic portion and the second elastic portion so that the first elastic portion is curved in a direction opposite to a direction that the second elastic portion is curved. The wide width portion has a width greater than that of the first elastic portion and the second elastic portion.

12 Claims, 11 Drawing Sheets

ELECTRICAL CONNECTOR

BACKGROUND OF THE INVENTION AND RELATED ART STATEMENT

The present invention relates to an electrical connector for electrically connecting a pair of circuit boards.

A conventional electrical connector is to be fixed to one circuit board, and is configured to engage with a mating side connector fixed to another circuit board, so that a pair of circuit boards is electrically connected.

For example, Patent Reference has disclosed such a conventional electrical connector. In the conventional electrical connector disclosed in Patent Reference includes a plurality of conductive contact members (terminals) arranged with a constant interval; a fixed housing for holding one edge portion of each of the conductive contact members; and a movable housing for holding the other edge portion of each of the conductive contact members and to be connected to a mating side connector. Further, each of the conductive contact members has a slit extending from the one edge portion to the other edge portion. In the conventional electrical connector disclosed in Patent Reference, each of the conductive contact members is divided with the slit, so that the conductive contact members is capable of elastically deforming. Accordingly, the movable housing is supported to be movable relative to the fixed housing.

Patent Reference: Japanese Patent Application Publication No. 2008-084756

In the conventional electrical connector disclosed in Patent reference, each of the conductive contact members has an exposed portion (a portion that directly contacts with air) exposed from the fixed housing and the movable housing and a held portion held with the fixed housing or the movable housing. As opposed to the held portion, the exposed portion tends to have a large impedance level. As a result, an impedance imbalance may be generated in each of the conductive contact members. When the exposed portion of each of the conductive contact members is enlarged (thereby increasing a sectional area thereof), it is possible to minimize the impedance imbalance. However, when the exposed portion of each of the conductive contact members is enlarged, it may be difficult for the conductive contact members to elastically deform. As a result, it may be difficult for the movable housing to smoothly move.

In the conventional electrical connector disclosed in Patent Reference, each of the conductive contact members (the terminals) is divided with the slit, so that the conductive contact members is capable of elastically and smoothly deforming. However, depending on a thickness (a width) of the conductive contact members, even if each of the conductive contact members (the terminals) is divided with the slit, it still may be difficult for the conductive contact members to elastically deform. As a result, it may be difficult for the movable housing to smoothly move relative to the fixed housing.

In view of the problems described above, an object of the present invention is to provide an electrical connector capable of solving the problems. In the present invention, the electrical connector includes a movable housing capable of smoothly moving.

Further objects and advantages of the present invention will be apparent from the following description of the present invention.

SUMMARY OF THE PRESENT INVENTION

According to a first aspect of the present invention, an electrical connector includes a fixed housing to be fixed to a board; a movable housing arranged to be movable relative to the fixed housing; and a plurality of terminals disposed between the fixed housing and the movable housing. Further, the terminals are arranged with a specific interval in between.

According to the first aspect of the present invention, each of the terminals includes a connecting portion held with the fixed housing and to be fixed to the board; a first elastic portion connected to the connecting portion and capable of elastically deforming; a terminal portion held with the movable housing and to be electrically connected to a mating side connector; a second elastic portion connected to the terminal portion and capable of elastically deforming; and a wide width portion connected between the first elastic portion and the second elastic portion so that the first elastic portion is curved in a direction opposite to a direction that the second elastic portion is curved. Further, the wide width portion has a width greater than that of the first elastic portion and the second elastic portion.

According to the first aspect of the present invention, in the electrical connector, the wide width portion is situated between the first elastic portion and the second elastic portion, so that the wide width portion becomes an exposed portion (a portion contacting with air) not being held with the fixed housing and the movable housing. Further, the wide width portion has a width greater than that of the first elastic portion and the second elastic portion. The first elastic portion and the second elastic portion are curved relative to the wide width portion, and have a width smaller than that of the wide width portion. Accordingly, the first elastic portion and the second elastic portion are capable of elastically deforming. As a result, the movable housing can be smoothly moving relative to the fixed housing.

According to the first aspect of the present invention, in the electrical connector, the wide width portion has a sectional area greater than that of the first elastic portion and the second elastic portion. Further, the wide width portion is away from the wide width portion at an adjacent position by a distance smaller than that of the first elastic portion and the second elastic portion. Accordingly, it is possible to make impedance compatible at least within each of the terminals and between a pair of the terminals. As a result, it is possible to prevent a high frequency signal from being disturbed due to incompatible impedance, thereby making it possible to smoothly perform high speed communication of the high frequency signal. In particular, it is effective in using a differential transmission method.

According to a second aspect of the present invention, an electrical connector includes a fixed housing to be fixed to a board; a movable housing arranged to be movable relative to the fixed housing; and a plurality of terminals disposed between the fixed housing and the movable housing.

According to the second aspect of the present invention, each of the terminals includes a connecting portion held with the fixed housing and to be fixed to the board; a plurality of first elastic portions connected to the connecting portion in an arrange state with a specific interval in between and capable of elastically deforming; a terminal portion held with the movable housing and to be electrically connected to a mating side connector; a plurality of second elastic portions connected to the terminal portion in an arrange state with a specific interval in between and capable of elastically deforming; and a plurality of wide width portions connected between the first elastic portions and the second elastic portions so that the first elastic portions are curved in a direction opposite to a direction that the second elastic portions are curved. Further, the wide width portions have a width greater than that of the first elastic portions and the second elastic portions.

According to the second aspect of the present invention, in the electrical connector, the wide width portions are situated between the first elastic portions and the second elastic portions, so that the wide width portions become an exposed portion (a portion contacting with air) not being held with the fixed housing and the movable housing. Further, the wide width portions have a width greater than that of the first elastic portions and the second elastic portions. The first elastic portions and the second elastic portions are curved relative to the wide width portions, and have a width smaller than that of the wide width portion. Accordingly, the first elastic portions and the second elastic portions are capable of elastically deforming. As a result, the movable housing can be smoothly moving relative to the fixed housing.

According to the second aspect of the present invention, in the electrical connector, the first elastic portions are connected with the connecting portions, and the second elastic portions are connected with the terminal portions. Further, the wide width portions have a width greater than that of the first elastic portions and the second elastic portions. Accordingly, it is possible to flow a large amount of electrical current through the terminals (for example, a power source terminal).

According to of a third aspect the present invention, in the electrical connector in the first aspect or the second aspect, the wide width portion may be preferably inclined by an acute angle relative to the first elastic portion and the second elastic portion. Further, the wide width portion may preferably extend toward a connection direction with the mating side connector.

According to of the third aspect the present invention, the first elastic portion and the second elastic portion are curved relative to the wide width portion in the opposite directions. Further, the wide width portion is inclined by an acute angle relative to the first elastic portion and the second elastic portion. In other words, the wide width portion, the first elastic portion, and the second elastic portion are arranged in a substantially Z character shape. Accordingly, it is possible to minimize a space (a shift) between an extension line from a position where the connecting portion is held with the fixed housing toward the connecting direction of the mating side connector and a position where the connecting portion is held with the movable housing. When such an offset amount is minimized, it is possible to prevent the first elastic portion and the second elastic portion from being excessively deformed when the movable housing is moved. As a result, it is possible to smoothly move the movable housing relative to the fixed housing, and smoothly deform the first elastic portion and the second elastic portion in the deformation direction.

According to of a fourth aspect the present invention, in the electrical connector in the third aspect, the fixed housing may preferably include a fixed side opening portion for accommodating the movable housing, so that the movable housing is retained in the fixed side opening portion with a specific space between an outer side surface of the movable housing and the fixed housing. Further, the movable housing may preferably include a movable side opening portion situated above the fixed housing for inserting the mating side connector from above.

According to the fourth aspect of the present invention, the connecting portion may preferably extend upwardly from the board, and may be preferably fitted in a fixed side pressing groove formed in a fixed side inner wall surface constituting the fixed side opening portion. The first elastic portion may preferably extend toward inside from an upper edge portion of the connecting portion. The wide width portion may be preferably inclined toward outside from an inner edge portion of the first elastic portion, and may preferably extend upwardly. The second elastic portion may preferably extend toward inside from an upper edge portion of the wide width portion. The terminal portion may preferably extend upwardly from an inner edge portion of the second elastic portion, and may be preferably fitted in a movable side pressing groove formed in a movable side inner wall surface constituting the movable side opening portion or a movable side outer wall surface of the movable housing.

According to the fourth aspect of the present invention, the wide width portion, the first elastic portion, and the second elastic portion are arranged in a substantially Z character shape. Accordingly, it is possible to minimize a space (a shift) between an extension line from a position where the connecting portion is held with the fixed housing toward the vertical upside and a position where the connecting portion is held with the movable housing. As a result, it is possible to smoothly move the movable housing relative to the fixed housing in a direction connecting the inside and the outside.

According to of a fifth aspect the present invention, in the electrical connector in the third aspect, the fixed housing may preferably include a fixed side opening portion for accommodating the movable housing, so that the movable housing is retained in the fixed side opening portion with a specific space between an outer side surface of the movable housing and the fixed housing. Further, the movable housing may preferably include a movable side opening portion situated on one side of the fixed housing in parallel to the board for inserting the mating side connector from one side.

According to the fifth aspect of the present invention, the connecting portion may preferably extend upwardly from the board, and may be preferably fitted in a fixed side pressing groove formed in a fixed side inner wall surface constituting the fixed side opening portion. The first elastic portion may preferably extend upwardly from an upper edge portion of the connecting portion. The wide width portion may be preferably inclined downwardly from an upper edge portion of the first elastic portion, and may preferably extend one side. The second elastic portion may preferably extend upwardly from one side edge portion of the wide width portion. The terminal portion may be preferably extend one side from an inner edge portion of the second elastic portion, and may be preferably fitted in a movable side pressing groove formed in a movable side inner wall surface constituting the movable side opening portion.

According to the fifth aspect of the present invention, the wide width portion, the first elastic portion, and the second elastic portion are arranged in a substantially Z character shape. Accordingly, it is possible to minimize a space (a shift) between an extension line extending horizontally from a position where the connecting portion is held with the fixed housing toward the connecting direction of the mating side connector and a position where the connecting portion is held with the movable housing. As a result, it is possible to smoothly move the movable housing relative to the fixed housing in a direction connecting the inside and the outside.

According to the present invention, in the electrical connector, it is possible to smoothly move the movable housing.

DETAILED DESCRIPTION OF THE PREFERRED EMBODIMENTS

Hereunder, embodiments of the present invention will be described with reference to the accompanying drawings. It should be noted that, in the accompanying drawings, a front direction is represented with Fr; a right-left direction is represented with X; a front-rear direction is represented with Y; and an up-down direction is represented with Z.

First Embodiment

Figure 1:
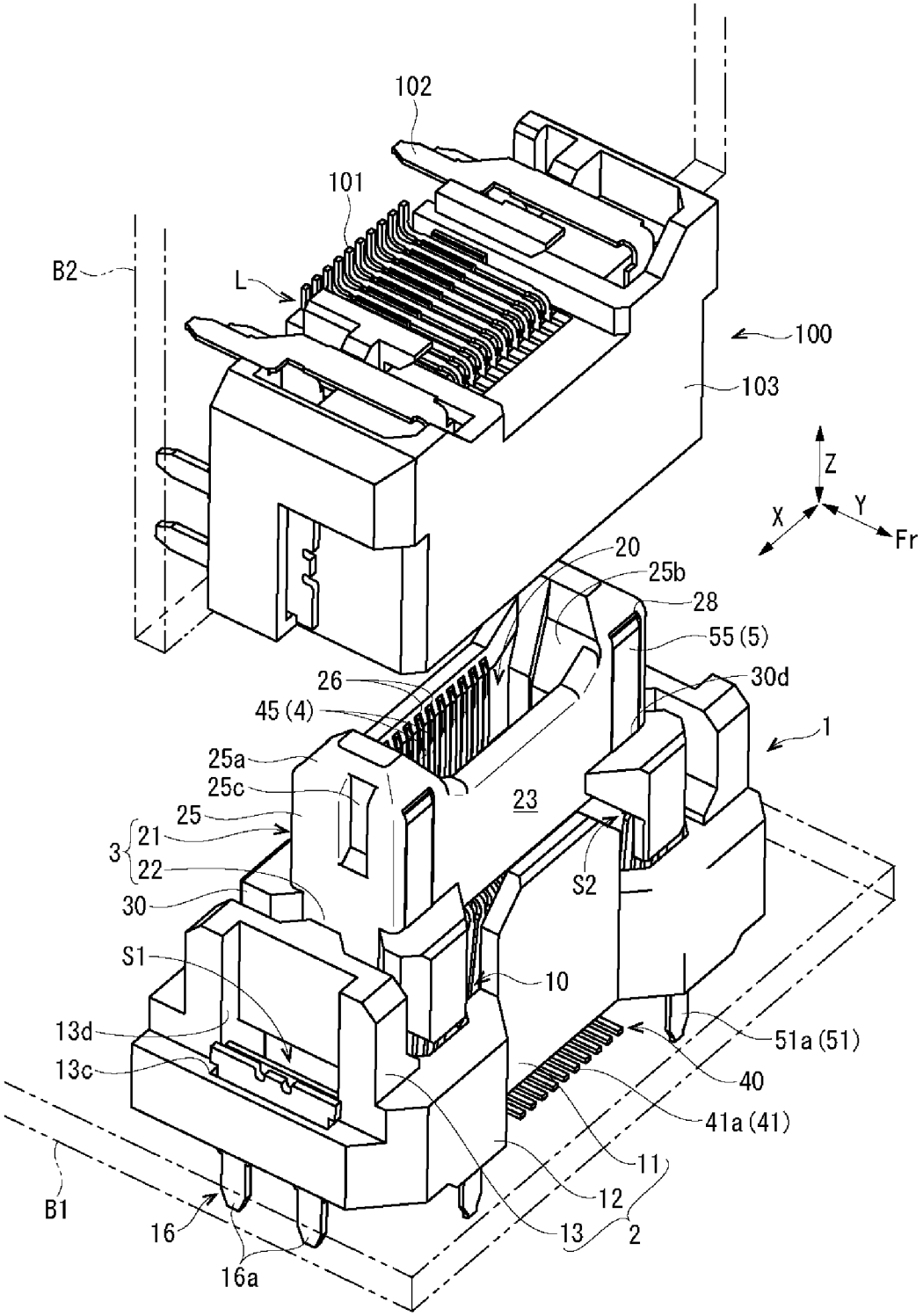
FIG. 1 is a perspective views showing an electrical connector and a mating side connector according to a first embodiment of the present invention.
Figure 2:
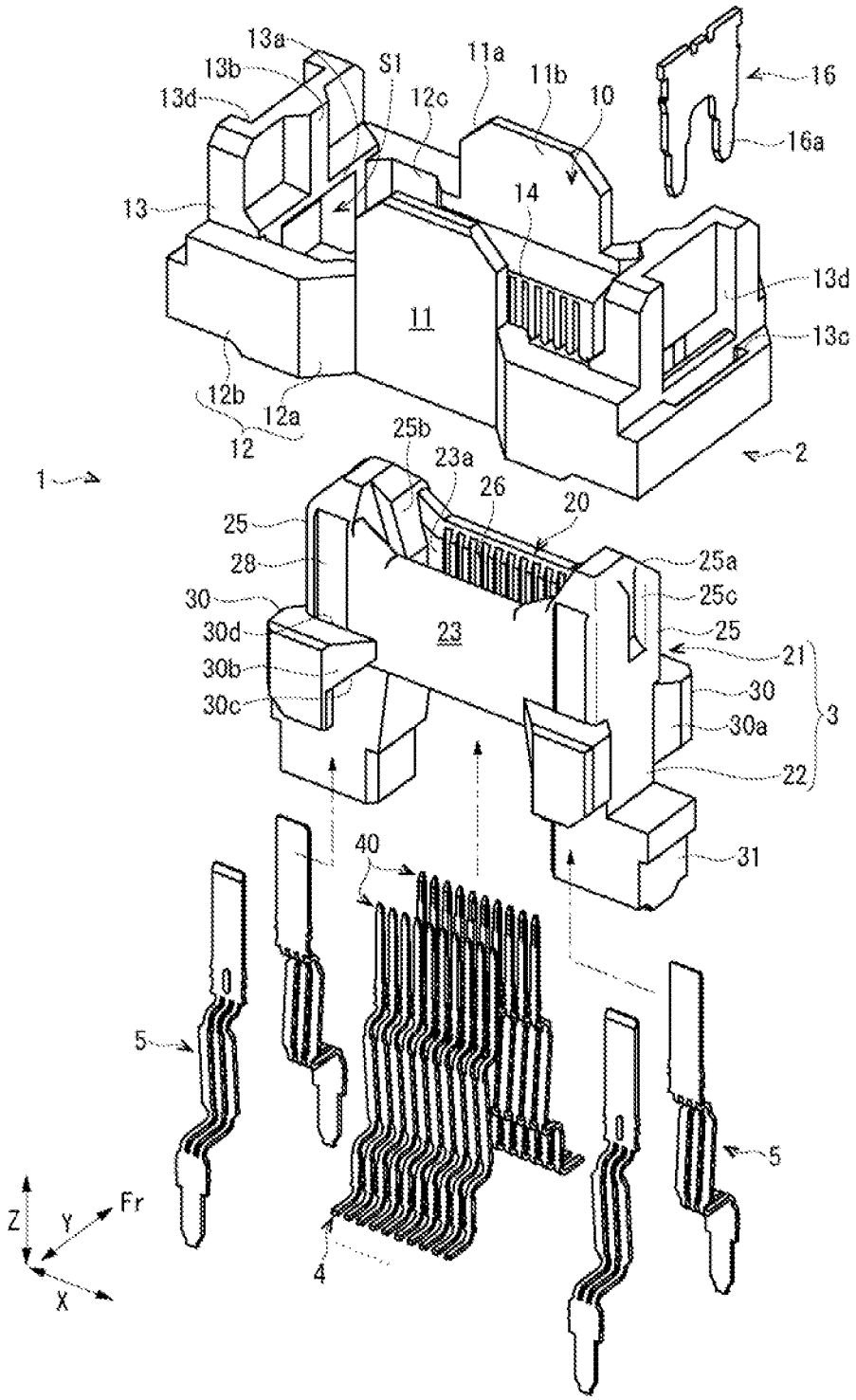
FIG. 2 is an exploded perspective view showing the electrical connector according to the first embodiment of the present invention.
Figure 3:
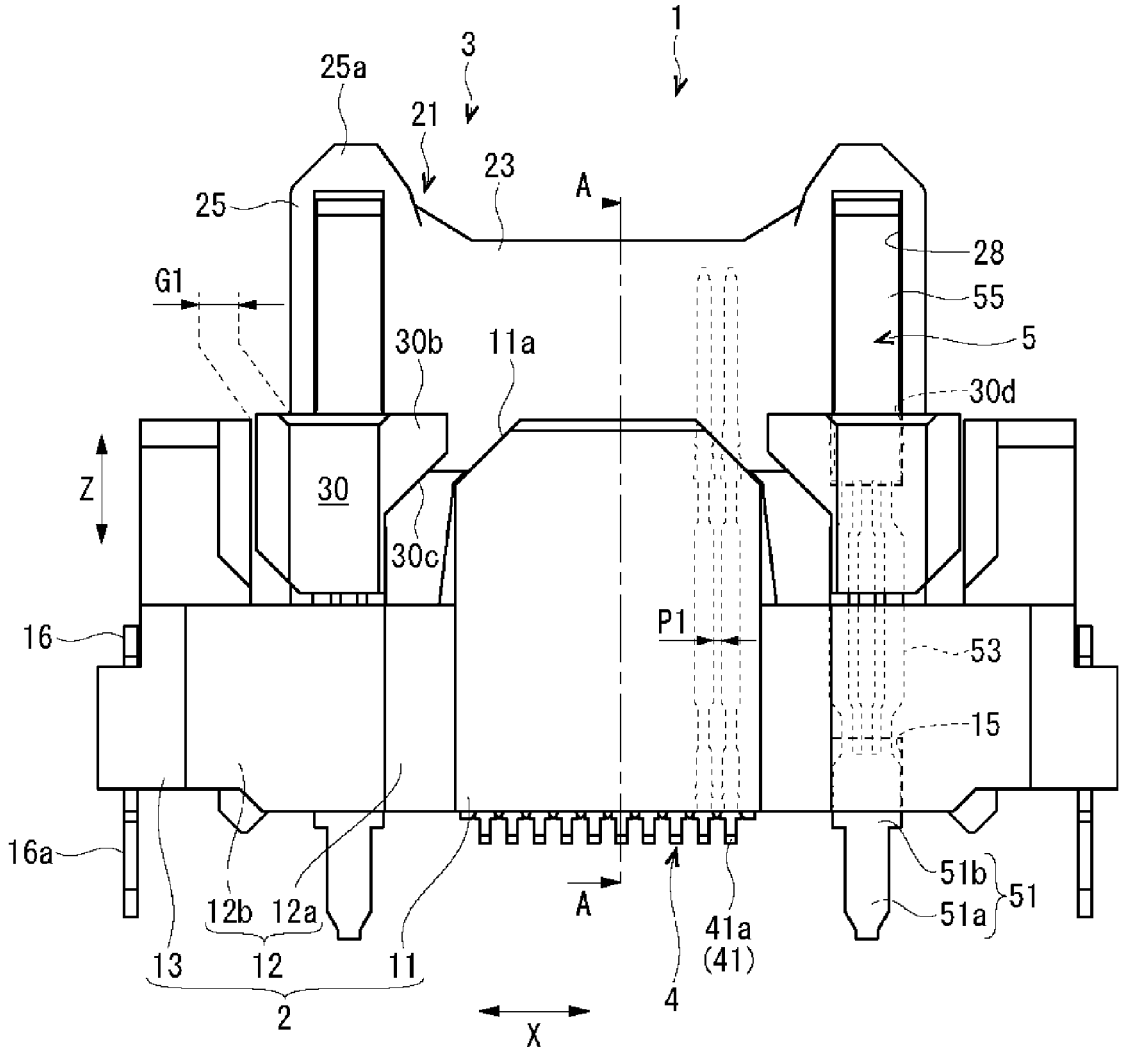
FIG. 3 is a front view showing the electrical connector according to the first embodiment of the present invention.
Figure 4:
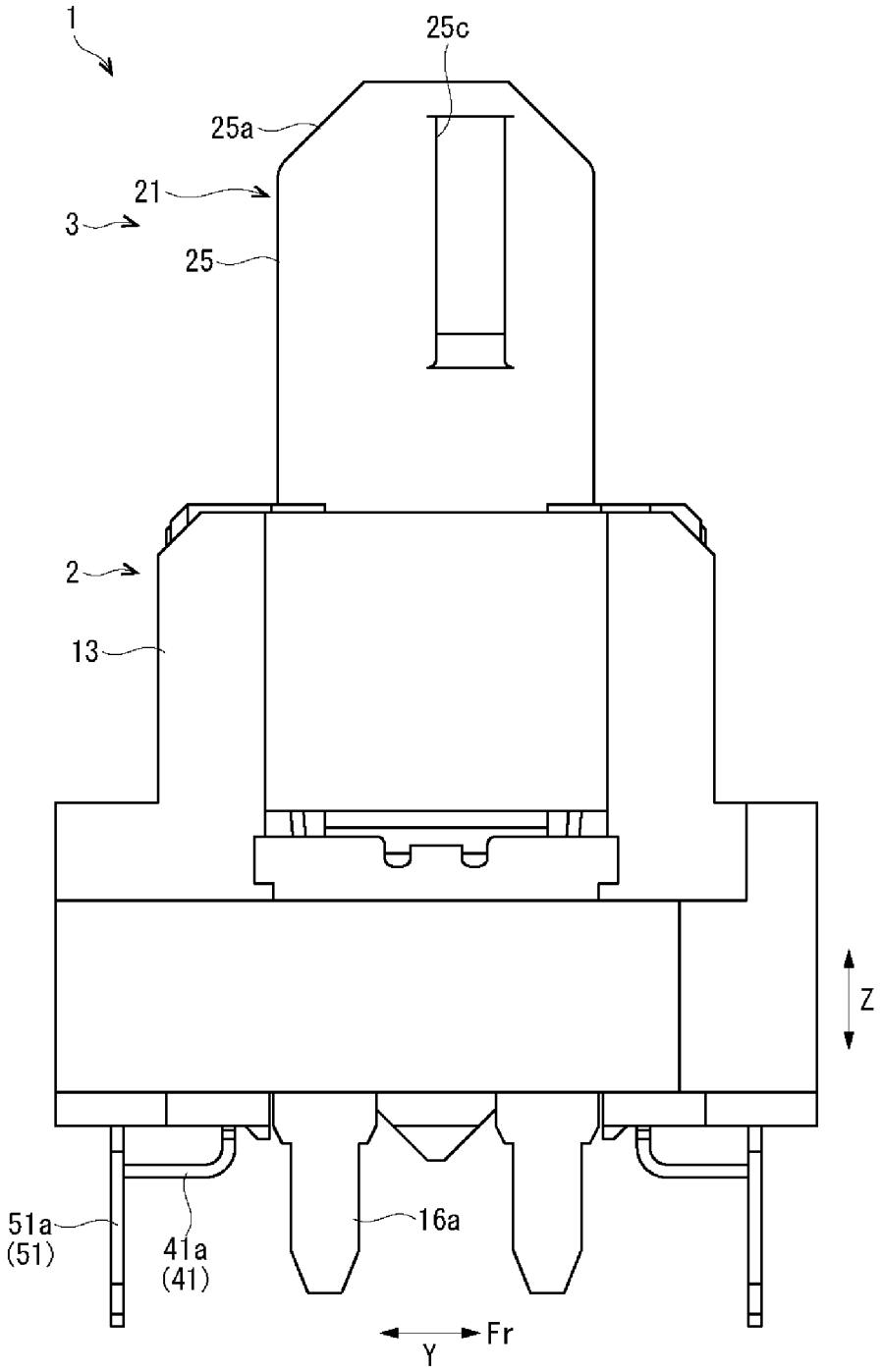
FIG. 4 is a side view showing the electrical connector according to the first embodiment of the present invention.
Figure 5:
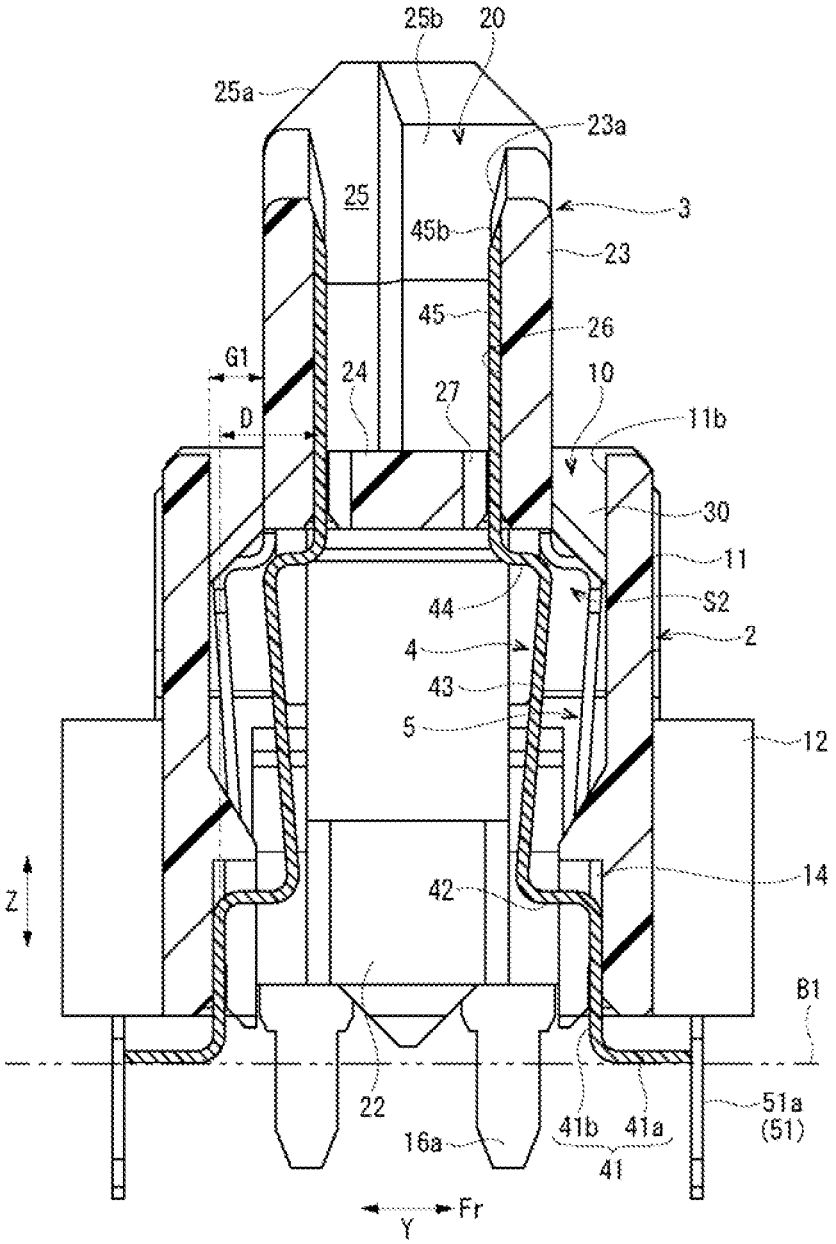
FIG. 5 is a sectional view showing the electrical connector taken along a line A-A in FIG. 3 according to the first embodiment of the present invention.

A first embodiment will be explained with reference to FIGS. 1 to 5. FIG. 1 is a perspective views showing an electrical connector 1 and a mating side connector 100 according to the first embodiment of the present invention. FIG. 2 is an exploded perspective view showing the electrical connector 1 according to the first embodiment of the present invention. FIG. 3 is a front view showing the electrical connector 1 according to the first embodiment of the present invention. FIG. 4 is a side view showing the electrical connector 1 according to the first embodiment of the present invention. FIG. 5 is a sectional view showing the electrical connector 1 taken along a line A-A in FIG. 3 according to the first embodiment of the present invention.

As shown in FIG. 1, the electrical connector 1 is a so-called floating connector, and is a plug (a meal type) to be attached to a board B1. The mating side connector 100 as a receptacle (a female type) is attached to a mating side board B2. When the electrical connector 1 is connected to the mating side connector 100, a pair of the board B1 and the mating side board B2 is electrically connected.

As shown in FIGS. 1 and 2, the electrical connector 1 includes a fixed housing 2 to be fixed to the board B1; a movable housing 3 arranged to be movable relative to the fixed housing 2; a plurality of connection terminals 4 disposed between the fixed housing 2 and the movable housing 3 and arranged with a specific interval; and a plurality of power source terminals 5 disposed between the fixed housing 2 and the movable housing 3 similarly to the connection terminals 4.

As shown in FIGS. 1 to 3, the fixed housing 2 includes a fixed side opening portion 10 penetrating in the up-down direction, and is formed in a substantially cylindrical shape. The fixed side opening portion 10 is formed such that the movable housing 3 can be retained in the fixed side opening portion 10 with a specific space G1 relative to an outer side surface of the movable housing 3.

In the first embodiment, the fixed housing 2 is integrally formed of an insulation material such as a synthetic resin and the like. Further, the fixed housing 2 includes a pair of fixed main body wall portions 11 arranged in the front-rear direction with the fixed side opening portion 10 in between; two pairs of extending wall portions 12 extending toward outside in the left-right direction from right and left edge portions of the fixed main body wall portions 11; and a pair of board fixing portions 13 arranged in the front-rear direction and connected to the extending wall portions 12 facing in the front-rear direction.

As shown in FIGS. 2 and 3, each of the fixed main body wall portions 11 is formed in a substantially rectangular shape elongating in the up-down direction in a front view thereof. Further, each of the fixed main body wall portions 11 includes an upper inclined surface 11*a* at both corners on an upper left side and an upper right side thereof such that the upper included surface 11*a* is formed as an obliquely cut corner. Further, each of the fixed main body wall portions 11 includes a smooth outer side surface and a fixed side inner surface 11*b*. The fixed side inner surface 11*b* as an inner side surface of each of the fixed main body wall portions 11 constitutes a part of the fixed side opening portion 10, and includes a protruding portion protruding inside at a lower portion thereof. In other words, each of the fixed main body wall portions 11 has the lower portion having a thickness greater than the upper portion thereof.

In the first embodiment, a plurality of fixed side pressing grooves 14 is formed in the lower portion (the thick portion) of the fixed side inner surface 11*b* of each of the fixed main body wall portions 11 such that the fixed side pressing grooves 14 extend upwardly from a lower edge (refer to FIG. 2). Each of the fixed side pressing grooves 14 is formed in a shape such that each of the fixed side pressing grooves 14 has a C character shaped sectional surface in a plan view.

In the first embodiment, each of the extending wall portions 12 is connected to a substantially lower half of each of the fixed main body wall portions 11 in a front view, and includes a lower edge surface formed to be flash with a lower edge surface of each of the fixed main body wall portions 11. Further, each of the extending wall portions 12 includes an inclined portion 12*a* and a parallel portion 12*b*. The inclined portion 12*a* is inclined toward outside in the left-right direction at the connecting portion thereof to the fixed main body wall portion 11 in the plan view. The parallel portion 12*b* extends from an outer edge portion of the inclined portion 12*a* toward outside in the left-right direction.

In the first embodiment, a power source fixed side pressing groove 15 is formed as a recessed portion in an inner side surface of each of the extending wall portions 12 at a lower portion thereof (refer to FIG. 3), that is, a lower portion of a fixed side inner wall surface 12*c* (refer to FIG. 2) constituting a part of the fixed side opening portion 10. The power source fixed side pressing groove 15 extends upward from a lower edge portion of each of the extending wall portions 12. Further, the power source fixed side pressing groove 15 has a substantially C character shaped sectional surface in the plan view, and has a height (a length) substantially the same as each of the fixed side pressing grooves 14. Further, the power source fixed side pressing groove 15 is formed to have a width in the left-right direction greater than that of each of the fixed side pressing grooves 14.

In the first embodiment, each of the board fixing portions 13 includes a lateral protruding strip portion 13*a* and a vertical protruding strip portion 13*b* on an inner side surface thereof in the left-right direction. The lateral protruding strip portion 13*a* extends in the front-rear direction at a center portion of each of the board fixing portions 13 in the up-down direction. The vertical protruding strip portion 13*b* extends upwardly from an upper side of the lateral protruding strip portion 13*a* at a center portion of each of the board fixing portions 13 in the front-rear direction. Both the lateral protruding strip portion 13*a* and the vertical protruding strip portion 13*b* have a substantially trapezoid shaped sectional surface. Further, an engaging space S1 having a substantially cubic shape is formed below the lateral protruding strip portion 13*a*.

In the first embodiment, each of the board fixing portions 13 further includes a lower portion of an outer side surface in the left-right direction that is protruding outside stepwise. A metal member fixing hole 13*c* is formed to penetrate the lower portion of each of the board fixing portions 13, and the metal member fixing hole 13*c* has a substantially rectangular shape in the plan view. A fixing metal member 16 (refer to FIG. 1) is tightly fitted into the metal member fixing hole 13*c*. A rectangular groove 13*d* is formed above the metal member fixing hole 13*c*. The rectangular groove 13*d* has a substantially rectangular shape and extends from outside toward inside in the left-right direction.

In the first embodiment, the fixing metal member 16 includes a pair of metal member leg portions 16*a* arranged in the front-rear direction at a lower portion thereof, so that the fixing metal member 16 is formed in a substantially U character shape. When the fixing metal member 16 is tightly fitted into the metal member fixing hole 13*c*, the metal member leg portions 16*a* extend downwardly from a lower edge surface of each of the board fixing portions 13 (refer to FIG. 3). Further, the metal member leg portions 16*a* penetrate through a through hole (not shown) formed in the board B1, so that the metal member leg portions 16*a* are fixed to the board B1 with solder and the like.

As shown in FIGS. 1 to 4, the movable housing 3 is integrally formed with an insulation material such as a synthetic resin and the like. Further, the movable housing 3 includes a movable main body portion 21 and a pair of movable leg portions 22 arranged in the front-rear direction. The movable main body portion 21 includes a movable side opening portion 20 opening upwardly, and is formed in a substantially rectangular cylindrical shape. The movable leg portions 22 are formed to extend downwardly from both left and right edge portions of the movable main body portion 21 in the left-right direction. With the movable main body portion 21 and the movable leg portions 22, the movable housing 3 is formed in a substantially inverted U character shape in the front view.

In the first embodiment, the movable side opening portion 20 is formed in a substantially cubic shape elongating in the left-right direction in the plan view. Further, the movable side opening portion 20 is arranged to accommodate a plurality of mating side terminals 101.

In the first embodiment, the movable main body portion 21 includes a pair of movable main body wall portions 23 arranged in the front-rear direction with the movable side opening portion 20 in between; a movable bottom portion 24 (refer to FIG. 5) arranged to connect lower portions of the movable main body wall portions 23 facing in the front-rear direction; and a pair of movable column portions 25 arranged in the front-rear direction and formed to support left and right outer edge portions of the movable main body wall portions 23 and the movable bottom portion 24.

As shown in FIGS. 2 and 3, each of the movable main body wall portions 23 is formed in a substantially rectangular shape elongating in the left-right direction in the front view. A plurality of movable side pressing grooves 26 is formed as a recess portion in an inner side surface of each of the movable main body wall portions 23, that is, a movable side inner wall surface 23*a* of each of the movable main body wall portions 23 constituting a part of the movable side opening portion 20. Each of the movable side pressing grooves 26 is formed to extend in the up-down direction, and is situated at a location corresponding to each of the fixed side pressing grooves 14, respectively. Further, each of the movable side pressing grooves 26 is formed in a groove shape having a substantially U character shape in the plan view, and is formed to extend from a lower edge portion to near an upper edge portion of each of the movable main body wall portions 23. It should be noted that an inclined surface expanding upwardly is formed at the upper edge portion of each of the movable side inner wall surfaces 23*a*.

As shown in FIG. 5, the movable bottom portion 24 is formed in a substantially cubic shape elongating in the left-right direction, so that the movable bottom portion 24 constitutes a bottom surface of the movable side opening portion 20. Further, the movable bottom portion 24 has a lower edge surface formed to be flash with a lower edge surface of each of the movable main body wall portions 23. A plurality of terminal through holes 27 penetrating in the up-down direction is formed in the movable bottom portion 24 at locations corresponding to each of the movable side pressing grooves 26. More specifically, each of the terminal through holes 27 is disposed along the movable side inner wall surfaces 23*a* paired in the front-rear direction, and is arranged in two rows so that the terminal through holes 27 become linear symmetry in the front-rear direction. It should be noted that the movable side pressing grooves 26 are formed in each of the terminal through holes 27.

As shown in FIGS. 2 and 3, each of the movable column portions 25 is formed in a substantially rectangular column shape. An engaging guide portion 25*a* is formed at an upper edge portion of each of the movable column portions 25, and four corners of the engaging guide portion 25*a* at a front portion, a rear portion, a left portion, and a right portion thereof are chamfered. Each of the engaging guide portions 25*a* is situated at an upper location relative to an upper edge surface of each of the movable main body wall portions 23. Further, a guide inclined surface 25*b* is formed on each of the movable column portions 25 on the side of the movable side opening portion 20 thereof, and the guide inclined surface 25*b* is inclined downwardly from a lower side of the engaging guide portion 25*a* toward inside in the left-right direction. Further, a guide groove 25*c* is formed as a recessed portion in an outer side surface of each of the movable column portions 25 in the left-right direction, and the guide groove 25*c* is formed to extend downwardly from the lower side of the engaging guide portion 25*a*.

In the first embodiment, a power source movable side pressing groove 28 is formed as a recessed portion in both side surfaces (a movable side outer wall surface) of each of the movable column portions 25 in the front-rear direction, and the power source movable side pressing groove 28 extends in the up-down direction. Further, the power source movable side pressing groove 28 is situated at a location corresponding to each of the power source fixed side pressing grooves 15. Further, the power source movable side pressing groove 28 is formed as a groove having a substantially U character shape sectional shape in the plan view, and extends from a lower edge of each of the movable column portions 25 to a lower edge of each of the engaging guide portions 25*a*. Further, the power source movable side pressing groove 28 is formed to have a width in the left-right direction greater than that of each of the movable side pressing grooves 26.

As shown in FIGS. 2 and 3, each of the movable leg portions 22 is integrally formed to extend downwardly from the lower edge of each of the movable column portions 25. Further, each of the movable leg portions 22 is formed to have a width increasing toward upward inside in the left-right direction from a location near the lower portion thereof in the up-down direction in the front view.

In the first embodiment, two pairs of movement regulating blocks 30 are disposed at an upper portion of each of the movable leg portions 22. The movement regulating blocks 30 are paired in the left-right direction, and protrude from both side surfaces of each of the movable leg portions 22 in the front-rear direction. The movement regulating blocks 30 paired in the left-right direction and disposed on the front side are formed to extend around from the front side surface to the outer side surface in the left-right direction between each of the movable leg portions 22 and each of the movable column portions 25.

In the first embodiment, each of the movement regulating blocks 30 paired in the left-right direction and disposed on the front side includes an outer inclined surface 30*a* inclined toward the outer surfaces of each of the movable leg portions 22 and each of the movable column portions 25 in the left-right direction. Further, each of the movement regulating blocks 30 paired in the left-right direction and disposed on the front side includes an inner inclined surface 30*b* inclined toward the front side surface of each of the movable main body wall portions 23. A lower inclined surface 30*c* is formed below each of the inner inclined surfaces 30*b* paired in the left-right direction and disposed on the front side, and is inclined downwardly toward outside in the left-right direction. It should be noted that each of the movement regulating blocks 30 paired in the left-right direction and disposed on the rear side includes the outer inclined surface 30*a*, the inner inclined surface 30*b*, and the lower inclined surface 30*c* at symmetrical locations in the front-rear direction.

In the first embodiment, a power source through hole 30*d* having a substantially rectangular shape is formed at the upper portion of each of the movement regulating blocks 30, so that the power source through hole 30*d* communicates with each of the power source movable side pressing grooves 28. Further, a movement space S2 (refer to FIG. 5) is formed between a lower inner surface of each of the movement regulating blocks 30 and a surface of each of the movable leg portions 22. It should be noted that each of the movable leg portions 22 paired in the left-right direction has a horizontally projected area having a shape slightly smaller and similar to that of the fixed side opening portion 10.

As shown in FIG. 2, an engaging block 31 having a substantially cubic shape is disposed at the lower portion of each of the movable leg portions 22, and the engaging block 31 is formed to protrude from the outer side surface in the left-right direction. Each of the engaging blocks 31 paired in the left-right direction has a flat surface flash with each of both side surfaces of each of the movable leg portions 22 in the front-rear direction. Further, each of the engaging blocks 31 has an upper portion protruding outside further than a lower portion thereof in the front view.

As shown in FIGS. 1 and 2, a plurality of the connection terminals 4 constitutes terminal rows 40 arranged with an equal interval in between in the left-right direction. In the electrical connector 1, two of the terminal rows 40 are arranged to be symmetrical in the front-rear direction relative to each of the fixed housing 2 and the movable housing 3.

Figure 6:
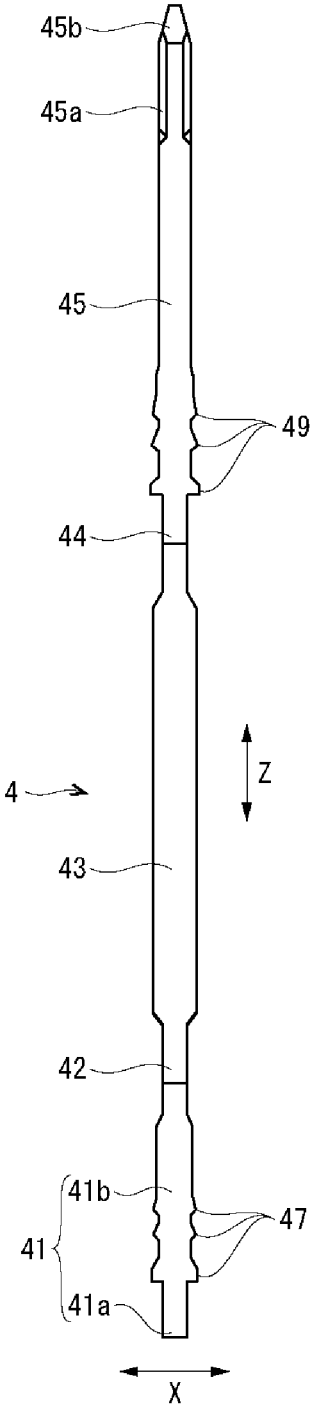
FIGS. 6(*a*) and 6(*b*) are views showing a connection terminal of the electrical connector according to the first embodiment of the present invention, wherein FIG. 6(*a*) is a front view showing the connection terminal, and FIG. 6(*b*) is a side view showing the connection terminal.
Figure 6:
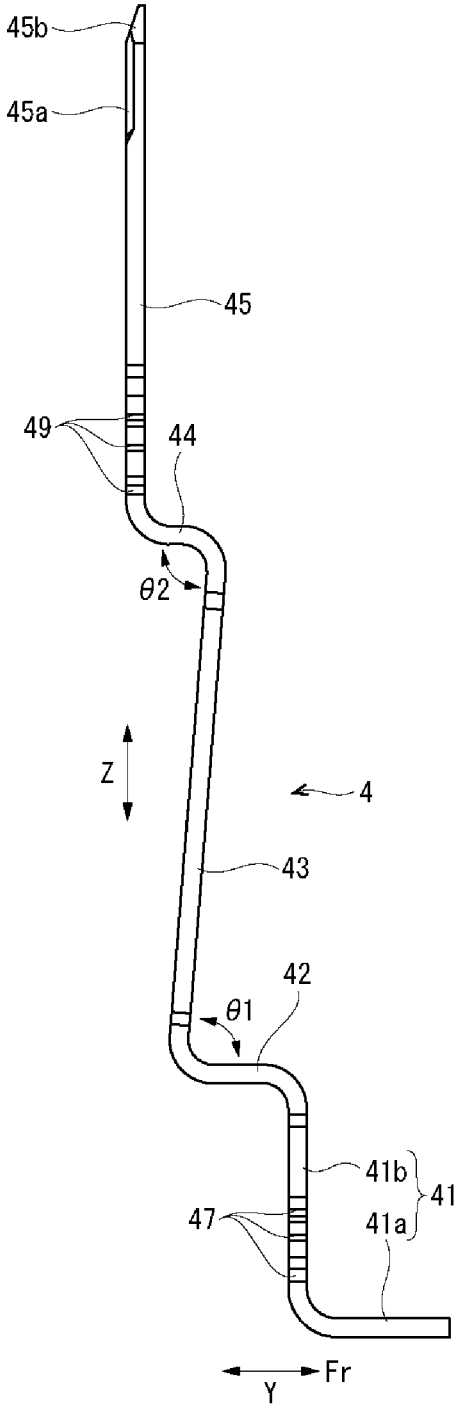

In the first embodiment, each of the connection terminals 4 has an identical configuration. Accordingly, in the following description, the configuration of one of the connection terminals 4 will be explained with reference to FIGS. 5 and 6(*a*)-6(*b*). FIGS. 6(*a*) and 6(*b*) are views showing the connection terminal 4 of the electrical connector 1 according to the first embodiment of the present invention. More specifically, FIG. 6(*a*) is a front view showing the connection terminal 4, and FIG. 6(*b*) is a side view showing the connection terminal 4. In the following description, otherwise specifically described, an outside (an outer edge) is defined as an outside of each of the fixed housing 2 and the movable housing 3 in the front-rear direction, and an inside (an inner edge) is defined as a center side of each of the fixed side opening portion 10 and the movable side opening portion 20 in the front-rear direction.

As shown in FIGS. 5 and 6(*a*)-6(*b*), the connection terminal 4 includes a connecting portion 41; a first elastic portion 42; a wide width portion 43; a second elastic portion 44; a terminal portion 45 integrally formed in this order upward from the side of the board B1. Further, the connection terminal 4 is formed through punching out a metal plate with conductivity into a thin strip shape, and bending the metal plate into a specific shape. Alternatively, the connection terminal 4 may be formed of a so-called punched out terminal obtained through punching out and processing into a specific shape.

In the first embodiment, the connecting portion 41 is arranged to be held with the fixed housing 2, and be fixed to the board B1. Further, the connecting portion 41 includes a board mounting portion 41*a* to be electrically connected to the board B1 with solder and the like, and a connection side pressing portion 41*b* extending upwardly from an inner edge portion (the board B1) of the board mounting portion 41*a*.

In the first embodiment, the board mounting portion 41*a* is formed to extend in parallel to the board B1. The connection side pressing portion 41*b* is formed to bend perpendicular to the board mounting portion 41*a*. Further, the connection side pressing portion 41*b* is arranged to be fitted into one of the fixed side pressing grooves 14 formed in the upper inclined surface 11*a* (refer to FIG. 5). Three pairs of connection side pressing protrusions 47 paired in the left-right direction are disposed on both side surfaces of the connection side pressing portion 41*b*, and the connection side pressing protrusions 47 are arranged with a specific interval in the up-down direction. The connection side pressing portion 41*b* has a length in the up-down direction substantially the same as that of each of the fixed side pressing grooves 14 in the up-down direction. When the connection side pressing portion 41*b* is fitted into one of the fixed side pressing grooves 14, an outer edge portion of the board mounting portion 41*a* is exposed outside from the fixed housing 2.

In the first embodiment, the first elastic portion 42 is connected to the connecting portion 41, and is configured to be capable of elastically deforming. Further, the first elastic portion 42 is formed to bend perpendicular to the connection side pressing portion 41*b*. Further, the first elastic portion 42 is arranged to extend inwardly from an upper edge portion of the connection side pressing portion 41*b* (the connecting portion 41), and substantially in parallel to the board B1. Further, the first elastic portion 42 has a length in the front-rear direction slightly greater than a thickness of each of the fixed main body wall portions 11.

In the first embodiment, the wide width portion 43 is formed to extend upwardly from an inner edge portion of the first elastic portion 42 and be inclined outwardly, so that an angle θ1 between the wide width portion 43 and the first elastic portion 42 becomes an acute angle (less than 90°). Further, the wide width portion 43 has a length in the up-down direction substantially the same as a height of each of the movable main body wall portions 23.

In the first embodiment, the second elastic portion 44 is connected to the terminal portion 45, and is configured to be capable of elastically deforming. Further, the second elastic portion 44 is formed to extend inside from an inner edge portion of the wide width portion 43, and substantially in parallel to the board B1. Further, the wide width portion 43 and the second elastic portion 44 are arranged such that an angle θ2 between the wide width portion 43 and the second elastic portion 44 becomes an acute angle (less than 90°). Further, the second elastic portion 44 has a length in the front-rear direction slightly smaller than that of the first elastic portion 42 in the front-rear direction.

Accordingly, in the first embodiment, the wide width portion 43 is disposed between the first elastic portion 42 and the second elastic portion 44 such that the first elastic portion 42 and the second elastic portion 44 are curved in opposite directions each other. Further, the wide width portion 43 is formed to extend in the up-down direction (the connecting direction relative to the mating side connector 100) while the wide width portion 43 is inclined such that the angle θ1 between the wide width portion 43 and the first elastic portion 42 and the angle θ2 between the wide width portion 43 and the second elastic portion 44 become an acute angle (less than 90°). In other words, the first elastic portion 42, the wide width portion 43, and the second elastic portion 44 are arranged in a substantially Z character shape in the side view (refer to FIGS. 5 and 6(*b*)). It should be noted that the first elastic portion 42, the wide width portion 43, and the second elastic portion 44 are arranged such that the angle θ1 becomes the same as the angle θ2 in the first embodiment.

In the first embodiment, the terminal portion 45 is configured to be held with the movable housing 3, and to be electrically connected to the mating side connector 100. Further, the terminal portion 45 is formed to be curved perpendicular to the second elastic portion 44. Further, the terminal portion 45 is arranged to extend upwardly (upwardly in the vertical direction) from an inner edge portion of the second elastic portion 44. Further, the terminal portion 45 is configured to be fitted into one of the movable side pressing grooves 26 formed in the movable side inner wall surface 23*a*.

In the first embodiment, three pairs of terminal side pressing protrusions 49 paired in the left-right direction are disposed on both side surfaces of the terminal portion 45. A pair of chamfered portions 45*a* paired in the left-right direction is disposed inside at an upper edge portion of the terminal portion 45. A tapered portion 45*b* is disposed above the chamfered portions 45*a* such that three sides except an outside of the tapered portion 45*b* are chamfered. Similar to the wide width portion 43, the terminal portion 45 has a length in the up-down direction substantially the same as the height of each of the movable main body wall portions 23.

In the first embodiment, each of the connecting portion 41, the first elastic portion 42, the wide width portion 43, the second elastic portion 44, and the terminal portion 45 constituting each of the connection terminals 4 has a length in the extension direction thereof that can be arbitrarily defined according to the length of each of the fixed side pressing grooves 14 and each of the movable side pressing grooves 26, the thickness of the fixed housing 2 and the movable housing 3, and the like.

As shown in FIG. 6(*a*), in the connection terminal 4, the first elastic portion 42 has a width in the left-right direction the same as that of the second elastic portion 44, and the connecting portion 41 has a width in the left-right direction the same as that of the terminal portion 45. Further, in the connection terminal 4, each of the first elastic portion 42 and the second elastic portion 44 has the smallest width in the left-right direction, so that the first elastic portion 42 and the second elastic portion 44 are capable of elastically deforming. Further, each of the connecting portion 41 and the terminal portion 45 has the width in the left-right direction slightly greater than that of each of the first elastic portion 42 and the second elastic portion 44. Further, the wide width portion 43 has the width in the left-right direction greater than that of each of the connecting portion 41 and the terminal portion 45. Further, the wide width portion 43 has the width in the left-right direction greater than a distance P1 between the wide width portions 43 situated adjacent to each other (refer to FIG. 3). It should be noted that the width of the connecting portion 41 in the left-right direction and the width of the terminal portion 45 in the left-right direction may be set arbitrarily, and may be set, for example, to be greater than that of the wide width portion 43.

Figure 7:
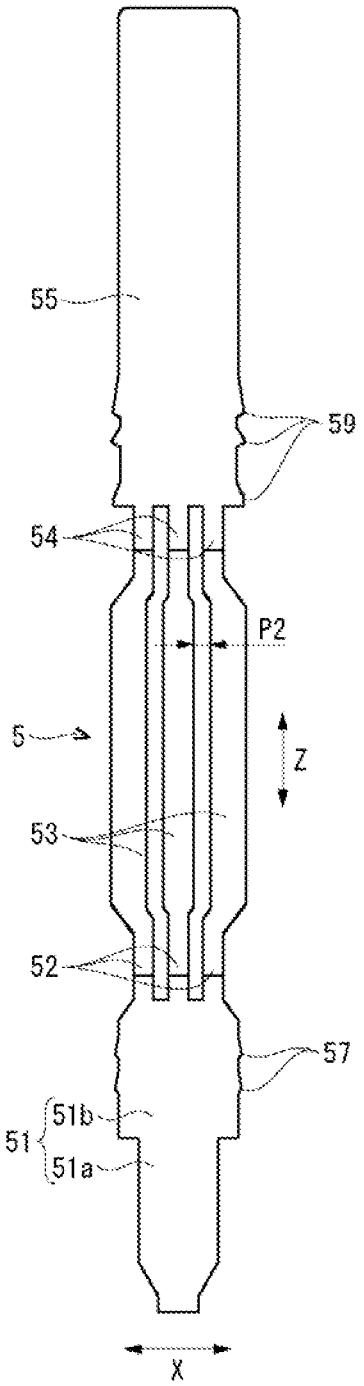
FIGS. 7(*a*) and 7(*b*) are views showing a power source terminal of the electrical connector according to the first embodiment of the present invention, wherein FIG. 7(*a*) is a front view showing the power source terminal, and FIG. 7(*b*) is a side view showing the power source terminal.
Figure 7:
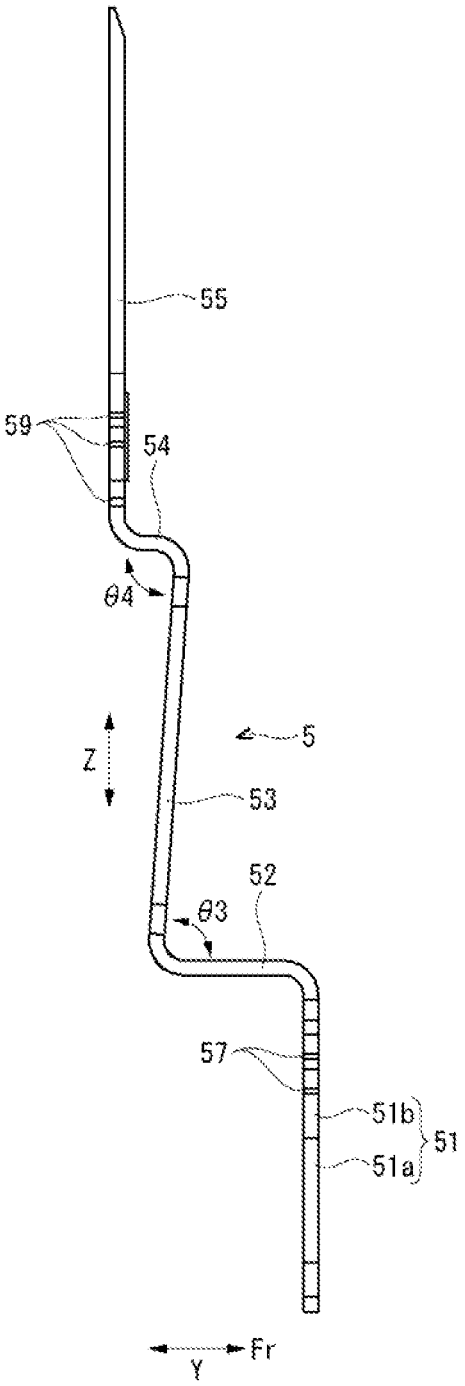

As shown in FIGS. 1 and 2, the power source terminal 5 is disposed at each of four locations on both side surfaces of the movable housing 3 in the front-rear direction at both edge portions of the movable housing 3 in the left-right direction. The power source terminals 5 have an identical configuration. Accordingly, the configuration of one of the power source terminals will be explained with reference to FIGS. 7(*a*) and 7(*b*). FIGS. 7(*a*) and 7(*b*) are views showing the power source terminal 5 of the electrical connector 1 according to the first embodiment of the present invention. More specifically, FIG. 7(*a*) is a front view showing the power source terminal 5, and FIG. 7(*b*) is a side view showing the power source terminal 5. It should be noted that explanations of portions of the power source terminals 5 similar to those of the connection terminal 4 are omitted.

As shown in FIGS. 7(*a*) and 7(*b*), the power source terminal 5 includes a power source side connecting portion 51; first power source side elastic portions 52; power source side wide width portions 53; second power source side elastic portions 54; a power source side terminal portion 55 integrally formed in this order upward from the side of the board B1. Further, the power source terminal 5 is formed through punching out a metal plate with conductivity into a thin strip shape, and bending the metal plate into a specific shape. Alternatively, the power source terminal 5 may be formed of a so-called punched out terminal obtained through punching out and processing into a specific shape.

In the first embodiment, the power source side connecting portion 51 is arranged to be held with the fixed housing 2, and be fixed to the board B1. Further, the power source side connecting portion 51 includes a power source side board mounting portion 51*a* to be electrically connected to the board B1 with solder and the like, and a power source side pressing portion 51*b* extending upwardly from an inner edge portion (the board B1) of the power source side board mounting portion 51*a*.

In the first embodiment, the power source side pressing portion 51*b* has a width in the left-right direction greater than that of the power source side board mounting portion 51*a*. Further, the power source side pressing portion 51*b* is arranged to be fitted into one of the power source fixed side pressing grooves 15 formed in the fixed side inner wall surface 12*c* (refer to FIG. 3). Two pairs of power source side pressing protrusions 57 paired in the left-right direction are disposed on both side surfaces of the power source side pressing portion 51*b*, and the power source side pressing protrusions 57 are arranged with a specific interval in the up-down direction. The power source side board mounting portion 51*a* and the power source side pressing portion 51*b* have a length in the up-down direction substantially the same as that of each of the power source fixed side pressing grooves 15 in the up-down direction. When the power source side pressing portion 51*b* is fitted into one of the power source fixed side pressing grooves 15, a lower edge portion of the power source side board mounting portion 51*a* is exposed below the fixed housing 2.

In the first embodiment, the first power source side elastic portions 52 are arranged in parallel with an equal interval (a specific distance P2) in between in the left-right direction. Further, each of the first power source side elastic portions 52 is connected to each of the power source side wide width portions 53, so that the first power source side elastic portions 52 are capable of elastically deforming. Further, the first power source side elastic portions 52 are formed to curve perpendicular to the power source side pressing portion 51*b*. Further, each of the first power source side elastic portions 52 is formed to extend inside from the upper edge portion of the power source side pressing portion 51*b* (the connecting portion) such that the first power source side elastic portions 52 extend substantially in parallel to the board B1. Each of the first power source side elastic portions 52 has a length in the front-rear direction substantially the same as a length of the power source side pressing portion 51*b* in the up-down direction.

In the first embodiment, the power source side wide width portions 53 are arranged in parallel with an equal interval (the specific distance P2) in between in the left-right direction. Further, each of the power source side wide width portions 53 is formed to extend upwardly from an inner edge portion of each of the first power source side elastic portions 52, and is inclined outwardly, so that an angle θ3 between each of the power source side wide width portions 53 and each of the first power source side elastic portions 52 becomes an acute angle (less than 90°). Further, each of the power source side wide width portions 53 has a length in the up-down direction substantially the same as a length of the power source side connecting portion 51 in the up-down direction.

In the first embodiment, the second power source side elastic portions 54 are arranged in parallel with an equal interval (the specific distance P2) in between in the left-right direction. Further, each of the second power source side elastic portions 54 is connected to the power source side terminal portion 55, so that the second power source side elastic portions 54 are capable of elastically deforming. Further, each of the power source side wide width portions 53 is formed to extend inwardly from an inner edge portion of each of the power source side wide width portions 53, and substantially in parallel to the board B1, so that an angle θ4 between each of the power source side wide width portions 53 and each of the second power source side elastic portions 54 becomes an acute angle (less than 90°). Further, each of the second power source side elastic portions 54 has a length in the front-rear direction substantially the same as a thickness of each of the movable main body wall portions 23.

Accordingly, in the first embodiment, the power source side wide width portions 53 are disposed between the first power source side elastic portions 52 and the second power source side elastic portions 54 such that the first power source side elastic portions 52 and the second power source side elastic portions 54 are curved in opposite directions each other. Further, the power source side wide width portions 53 are formed to extend in the up-down direction (the connecting direction relative to the mating side connector 100) while the power source side wide width portions 53 are inclined such that the angle θ3 between the power source side wide width portions 53 and the first power source side elastic portions 52 and the angle θ4 between the power source side wide width portions 53 and the second power source side elastic portions 54 become an acute angle (less than 90°). In other words, the first power source side elastic portions 52, the power source side wide width portions 53, and the second power source side elastic portions 54 are arranged in a substantially Z character shape in the side view (refer to FIG. 7(*b*)). It should be noted that the first power source side elastic portions 52, the power source side wide width portions 53, and the second power source side elastic portions 54 are arranged such that the angle θ3 becomes the same as the angle θ4 in the first embodiment.

In the first embodiment, the power source side terminal portion 55 is configured to be held with the movable housing 3, and to be electrically connected to the mating side connector 100. Further, the power source side terminal portion 55 is formed to be curved perpendicular to the second power source side elastic portions 54. Further, the power source side terminal portion 55 is arranged to extend upwardly (upwardly in the vertical direction) from an inner edge portion of the second power source side elastic portions 54. Further, the power source side terminal portion 55 is configured to be fitted into one of the power source movable side pressing grooves 28 formed in each of the movable column portions 25 (refer to FIG. 3).

In the first embodiment, three pairs of power source terminal side pressing protrusions 59 paired in the left-right direction are disposed on both side surfaces of the power source side terminal portion 55 at a lower portion thereof. Further, the power source side terminal portion 55 has a length in the up-down direction slightly greater than the height of each of the movable main body wall portions 23.

In the first embodiment, each of the power source side connecting portion 51, the first power source side elastic portions 52, the power source side wide width portions 53, the second power source side elastic portions 54, and the power source side terminal portion 55 constituting the power source terminal 5 has a length in the extension direction thereof that can be arbitrarily defined according to the length of each of the power source fixed side pressing grooves 15 and each of the power source movable side pressing grooves 28, the thickness of the fixed housing 2 and the movable housing 3, and the like.

As shown in FIG. 7(*a*), in the power source terminal 5, each of the first power source side elastic portions 52 has a width in the left-right direction the same as that of each of the second power source side elastic portions 54. Further, each of the first power source side elastic portions 52 and the second power source side elastic portions 54 has the smallest width in the left-right direction, so that the first power source side elastic portions 52 and the second power source side elastic portions 54 are capable of elastically deforming. Further, each of the power source side wide width portions 53 has an identical width in the left-right direction. Further, each of the power source side wide width portions 53 has the width in the left-right direction greater than that of each of the first power source side elastic portions 52 and the second power source side elastic portions 54. Further, each of the power source side wide width portions 53 has the width in the left-right direction greater than the distance P2.

In the first embodiment, the power source side pressing portion 51*b* of the power source side connecting portion 51 is disposed to connect the first power source side elastic portions 52 in the left-right direction. The power source side pressing portion 51*b* has the width in the left-right direction greater than a total width in the left-right direction of the first power source side elastic portions 52 arranged in parallel with the distance P2 in between. Similarly, the power source side terminal portion 55 is disposed to connect the second power source side elastic portions 54 in the left-right direction. Further, the power source side terminal portion 55 has the width in the left-right direction greater than a total width in the left-right direction of the second power source side elastic portions 54 arranged in parallel with the distance P2 in between.

In the first embodiment, the total width in the left-right direction of the power source side wide width portions 53 arranged in parallel with the distance P2 in between is greater than the width in the left-right direction of the power source side pressing portion 51*b* and the power source side terminal portion 55. It should be noted that the width of the power source side connecting portion 51 in the left-right direction and the width of the power source side terminal portion 55 in the left-right direction may be set arbitrarily, and may be set, for example, to be greater than the total width in the left-right direction of the power source side wide width portions 53 arranged in parallel as three members.

An operation of assembling the electrical connector 1 will be explained next with reference to FIGS. 2 and 5.

First, the connection terminals 4 are fixed to the movable housing 3. More specifically, a user of the electrical connector 1 attaches the movable housing 3 and the connection terminals 4 to a fixing jig (not shown) such that the connection terminals 4 arranged with an identical interval (the two rows of the terminal rows 40) face the specific locations disposed at the lower portion of the movable housing 3. In the next step, the terminal portion 45 of each of the connection terminals 4 is inserted upwardly into each of the terminal through holes 27 (each of the movable side pressing grooves 26) opening and aligned in parallel in the left-right direction. It should be noted that the operation of attaching the terminal portion 45 of each of the connection terminals 4 to the movable housing 3 is substantially concurrently performed relative to the connection terminals 4 using an attachment jig (not shown) having a comb teeth shape. Afterward, when the attachment jig is removed upwardly, the terminal portion 45 of each of the connection terminals 4 is fitted into each of the movable side pressing grooves 26.

When the terminal portion 45 of each of the connection terminals 4 is fitted into each of the movable side pressing grooves 26, the terminal side pressing protrusions 49 arranged in the two pairs at the upper side are tightly fitted into the movable side pressing grooves 26. Accordingly, each of the connection terminals 4 is tightly held with each of the movable side pressing grooves 26 in a state that each of the connection terminals 4 is prevented from being come off. It should be noted that the terminal side pressing protrusions 49 arranged at the lowest side are situated at the lower portion of each of the movable side pressing grooves 26.

Through the operation described above, the terminal rows 40 are fixed to the movable housing 3. It should be noted that the operation of attaching the terminal rows 40 to the movable housing 3 is substantially concurrently performed relative to the terminal rows 40 paired in the front-rear direction. Alternatively, the operation of attaching the terminal rows 40 to the movable housing 3 may be performed separately.

Similarly, the power source terminals 5 are fixed to the movable housing 3. More specifically, the user of the electrical connector 1 attaches the movable housing 3 and the power source terminals 5 to a fixing jig (not shown) such that each of the power source terminals 5 faces the specific location disposed at the lower portion of the movable housing 3. In the next step, the power source side terminal portion 55 of each of the power source terminals 5 is inserted upwardly into each of the power source through holes 30*d* (each of the power source movable side pressing grooves 28). It should be noted that the operation of attaching the power source side terminal portion 55 of each of the power source terminals 5 to the movable housing 3 is substantially concurrently performed relative to the power source terminals 5 using the attachment jig described above. Afterward, when the attachment jig is removed upwardly, the power source side terminal portion 55 of each of the power source terminals 5 is fitted into each of the power source movable side pressing grooves 28.

When the power source side terminal portion 55 of each of the power source terminals 5 is fitted into each of the power source movable side pressing grooves 28, the power source terminal side pressing protrusions 59 arranged in the two pairs at the upper side are tightly fitted into the power source movable side pressing grooves 28. Accordingly, each of the power source terminals 5 is tightly held with each of the power source movable side pressing grooves 28 in a state that each of the power source terminals 5 is prevented from being come off. It should be noted that the power source terminal side pressing protrusions 59 arranged at the lowest side are situated at the lower portion of each of the power source movable side pressing grooves 28.

Through the operation described above, the power source side terminal portions 55 are fixed to the movable housing 3. It should be noted that the operation of attaching the power source side terminal portions 55 to the movable housing 3 is substantially concurrently performed relative to the terminal rows 40. Alternatively, the operation of attaching the power source side terminal portions 55 to the movable housing 3 may be performed separately before or after the terminal rows 40 are fixed to the movable housing 3.

In the next step, after the terminal rows 40 arranged in the pair in the front-rear direction and the power source terminals 5 disposed at the four locations are fixed to the movable housing 3, the movable housing 3 is supported on the fixed housing 2. More specifically, the user of the electrical connector 1 attaches the fixed housing 2 and the movable housing 3 to a fixing jig (not shown) such that the movable housing 3 faces the specific location disposed at the lower portion of the fixed housing 2. Then, the user moves the movable housing 3 upwardly from the lower edge of the fixed side opening portion 10.

In the first embodiment, the operation of attaching the connecting portion 41 to the fixed housing 2 may be performed similarly to the operation of attaching the wide width portions 43 to the movable housing 3. When the attachment jig is removed upwardly, each of the connecting portions 41 (each of the connection side pressing portions 41*b*) is fitted into each of the fixed side pressing grooves 14. At the same time, each of the power source side connecting portions 51 (each of the power source side pressing portions 51*b*) is fitted into each of the power source fixed side pressing grooves 15.

When the movable housing 3 is fitted (pushed) into the fixed housing 2, the connection side pressing protrusions 47 arranged on each of the connection side pressing portions 41*b* in the two pairs at the upper side are tightly fitted into the fixed side pressing grooves 14. Substantially at the same time, the power source side pressing protrusions 57 arranged on each of the power source side pressing portions 51*b* in the two pairs at the upper side are tightly fitted into the power source fixed side pressing grooves 15. When the movable housing 3 is fitted (pushed) into the fixed housing 2 to a specific extent, each of the connection side pressing portions 41*b* is tightly held with each of the fixed side pressing grooves 14 in a state that each of the connection side pressing portions 41*b* is prevented from being come off. Further, each of the power source side pressing portions 51*b* is tightly held with each of the power source fixed side pressing grooves 15 in a state that each of the power source side pressing portions 51*b* is prevented from being come off. It should be noted that the connection side pressing protrusions 47 arranged at the lowest side are situated at the lower portion of each of the fixed side pressing grooves 14.

Through the operation described above, the electrical connector 1 is fully assembled. After the electrical connector 1 is assembled, the electrical connector 1 is placed on the board B1. Afterward, the board mounting portion 41*a* of each of the connection terminals 4, the power source side board mounting portion 51*a* of each of the power source terminals 5, and the metal member leg portions 16*a* of each of the fixing metal members 16 are fixed to the board B1 with solder.

In the first embodiment, when the electrical connector 1 is fully assembled, the movable main body portion 21 of the movable housing 3 is situated above the upper edge surface of each of the extending wall portions 12 of the fixed housing 2. Further, in this state, a small space is created between the lower edge surface of each of the fixed main body wall portions 11 and the board mounting portion 41*a* of each of the connecting portions 41. More specifically, when the electrical connector 1 is mounted on the board B1, the fixed housing 2 is fixed at a position where the fixed housing 2 is slightly floated from the board B1 through each of the connection terminals 4.

Further, in the first embodiment, when the electrical connector 1 is fully assembled, each of the connection terminals 4 bridges between the fixed housing 2 and the movable housing 3. Further, each of the first elastic portions 42, each of the wide width portions 43, and each of the second elastic portions 44 become exposed portions contacting with air in the fixed side opening portion 10. Further, a space (the distance P1) is created between each of the first elastic portions 42, each of the wide width portions 43, and each of the second elastic portions 44 arranged adjacently. Further, each of the first elastic portions 42 has the length set such that each of the wide width portions 43 is away from the fixed side inner surface 11*b*. Further, each of the second elastic portions 44 extends toward inside from the upper edge portion of each of the wide width portions 43 inclined outwardly, and has the length such that each of the terminal portions 45 can be inserted into each of the movable side pressing grooves 26.

Similarly, in the first embodiment, when the electrical connector 1 is fully assembled, each of the power source terminals 5 bridges between the fixed housing 2 and the movable housing 3. Further, each of the first power source side elastic portions 52, each of the power source side wide width portions 53, and each of the second power source side elastic portions 54 become exposed portions contacting with air in the fixed side opening portion 10 and the movement space S2. Further, a space (the distance P2) is created between each of the first power source side elastic portions 52, each of the power source side wide width portions 53, and each of the second power source side elastic portions 54 arranged adjacently. Further, each of the first power source side elastic portions 52 has the length set such that each of the power source side wide width portions 53 is away from the fixed side inner surface 12*c*. Further, each of the second power source side elastic portions 54 extends toward inside from the upper edge portion of each of the power source side wide width portions 53 inclined outwardly, and has the length such that each of the power source side terminal portions 55 can be inserted into each of the power source movable side pressing grooves 28.

In the electrical connector 1 in the first embodiment, as described above, each of the first elastic portions 42, each of the second elastic portions 44, each of the first power source side elastic portions 52, and each of the second power source side elastic portions 54 are capable of elastically deforming, so that the movable housing 3 can move in the front-rear direction and the left-right direction relative to the fixed housing 2. More specifically, in the connection terminals 4, a stress is concentrated on the curved portion between each of the connecting portions 41 (each of the connection side pressing portions 41*b*) and each of the first elastic portions 42, and the curved portion between each of the first elastic portions 42 and each of the wide width portions 43. Accordingly, mainly the curved portions elastically deform. Similarly, mainly the curved portion between each of the wide width portions 43 and each of the second elastic portions 44, and the curved portion between each of the second elastic portions 44 and the terminal portions 45 elastically deform.

Further, in the power source terminals 5, a stress is concentrated on the curved portion between each of the power source side connecting portions 51 (each of the power source side pressing portions 51*b*) and each of the first power source side elastic portions 52, and the curved portion between each of the first power source side elastic portions 52 and each of the power source side wide width portions 53. Accordingly, mainly the curved portions elastically deform. Similarly, mainly the curved portion between each of the power source side wide width portions 53 and each of the second power source side elastic portions 54, and the curved portion between each of the second power source side elastic portions 54 and the power source side terminal portions 55 elastically deform. As described above, the connection terminals 4 and the power source terminals 5 support the movable housing 3 of the electrical connector 1, so that the movable housing 3 can move within the fixed side opening portion 10 of the fixed housing 2 in the front-rear direction and the left-right direction.

In the first embodiment, the movable leg portions 22 of the movable housing 3 paired in the left-right direction are disposed within both left and right edge regions of the fixed side opening portion 10. Further, the specific space G1 is created between the outer side surface of each of the movable leg portions 22 and the inner circumferential wall surface of the fixed side opening portion 10 (refer to FIG. 3). Further, on both front and rear sides, each of the fixed main body wall portions 11 is situated with the specific space between the inner inclined surfaces 30*b* of the movement regulating blocks 30 paired in the left-right direction. Further, the lower inclined surface 30*c* of each of the movement regulating blocks 30 is inclined by the angle corresponding to the upper inclined surface 11*a* of each of the fixed main body wall portions 11.

In the first embodiment, each of the engaging blocks 31 formed on each of the movable leg portions 22 is loosely fitted in the engaging space S1 formed below the lateral protruding strip portion 13*a* of each of the board fixing portions 13. It is configured that the upper surface of each of the engaging blocks 31 abuts against the ceiling surface of the engaging space S1 (the lower surface of the lateral protruding strip portion 13*a*), so that the movable housing 3 does not come off upwardly from the fixed housing 2. It should be noted that a space substantially the same as the specific space G1 is formed between both left and right side surfaces of each of the engaging blocks 31 and both left and right side surfaces of the engaging space S1.

Accordingly, it is configured such that the movable housing 3 can move in the front-rear direction and the left-right direction inside the fixed side opening portion 10 of the fixed housing 2 within the specific space G1. More specifically, it is configured that the outer side surface of each of the movable leg portions 22 abuts against the inner circumferential wall surface of the fixed side opening portion 10, and the side surface of each of the engaging blocks 31 abuts against the side surface of the engaging space S1. Accordingly, it is possible to restrict the movement of the movable housing 3 within the specific range.

An operation of connecting the electrical connector 1 to the mating side connector 100 will be briefly explained next with reference to FIG. 1.

As shown in FIG. 1, the mating side connector 100 includes a plurality of mating side terminals 101 and four mating side power source terminals 102. The mating side terminals 101 are arranged in two mating side terminal rows L arranged with an equal interval in the left-right direction. Further, the mating side connector 100 includes a mating side housing 103 having a mating side opening portion (not shown) opened downwardly and a mating side engaging portion (not shown) disposed inside the mating side opening portion for holding the mating side terminal rows L.

In the first embodiment, when the electrical connector 1 is connected to the mating side connector 100, the user inserts the movable housing 3 of the electrical connector 1 into the mating side opening portion of the mating side connector 100. It should be noted that the engaging guide portions 25*a* paired in the left-right direction are arranged to guide the movable housing 3 when the movable housing 3 is inserted into the mating side opening portion. At this time, the guide inclined surface 25*b* of the movable housing 3 paired in the left-right direction and the guide groove 25*c* of the movable housing 3 paired in the left-right direction are arranged to guide the mating side engaging portion, so that the mating side engaging portion is inserted into the movable side opening portion 20. Accordingly, each of the mating side terminals 101 contacts with the terminal portion 45 of each of the connection terminals 4, and each of the mating side power source terminals 102 contacts with the power source side terminal portion 55 of each of the power source terminals 5. As a result, the board B1 is electrically connected to the mating side board B2.

As described above, in the electrical connector 1 in the first embodiment, the first elastic portions 42, the second elastic portions 44, the first power source side elastic portions 52, and the second power source side elastic portions 54 are configured to elastically deform, so that the movable housing 3 is capable of moving or shifting relative to the fixed housing 2. Accordingly, even if the connection terminals 4 are shifted relative to the mating side terminals 101, or the power source terminals 5 are shifted relative to the mating side power source terminals 102, it is possible to maintain secure electrical connection between the electrical connector 1 and the mating side connector 100. It should be noted that when the electrical connector 1 is connected to the mating side connector 100, the lower edge surface of the mating side housing 103 abuts against the upper surface of each of the movement regulating blocks 30. Accordingly, it is possible to restrict the movement of the mating side connector 100 in the connecting direction relative to the electrical connector 1.

As described above, in the electrical connector 1 in the first embodiment, the wide width portions 43 of the connection terminals 4 are exposed between the fixed housing 2 and the movable housing 3, and have the width in the left-right direction (the parallel arrangement direction) greater than that of the first elastic portions 42 and that of the second elastic portions 44. Accordingly, the wide width portions 43 have the sectional area greater than those of the first elastic portions 42 and the second elastic portions 44. Further, the wide width portions 43 are arranged with the distance P1 in between, and the distance P1 becomes relatively small. As a result, it is possible to easily match impedance at least one of between each of the connection terminals 4 or between the connection terminals 4 arranged adjacently. Therefore, it is possible to prevent a high frequency signal from being disturbed due to impedance mismatch, thereby making it possible to properly transmit the high frequency signal at a high speed. Especially, it is possible to effectively transmit the high frequency signal using a differential transmission method.

Similarly, as described above, in the electrical connector 1 in the first embodiment, the power source side wide width portions 53 of the power source terminals 5 are exposed between the fixed housing 2 and the movable housing 3, and have the width in the left-right direction (the parallel arrangement direction) greater than that of the first power source side elastic portions 52 and that of the second power source side elastic portions 54. Accordingly, the power source side wide width portions 53 have the sectional area greater than those of the first power source side elastic portions 52 and the second power source side elastic portions 54. Further, the power source side wide width portions 53 are arranged with the specific distance in between, and the specific distance becomes relatively small. Further, the first power source side elastic portions 52 are connected with the power source side connecting portions 51 (the power source side pressing portion 51*b*), and the second power source side elastic portions 54 are connected with the power source side terminal portions 55. Further, the power source side wide width portions 53 have the width in the left-right direction greater than that of the first power source side elastic portions 52 and that of the second power source side elastic portions 54. Accordingly, it is possible to flow a relatively large amount of an electrical current.

As described above, in the electrical connector 1 in the first embodiment, the first elastic portions 42 and the second elastic portions 44 are formed to be curved relative to the wide width portions 43, and have the width smaller than that of the wide width portions 43. Similarly, the first power source side elastic portions 52 and the second power source side elastic portions 54 have the width smaller than that of the power source side wide width portions 53. Accordingly, the first elastic portions 42, the wide width portions 43, the first power source side elastic portions 52, and the power source side wide width portions 53 are capable of flexibly and elastically deforming. Accordingly, the movable housing 3 is capable of smoothly moving or shifting relative to the fixed housing 2.

As described above, in the electrical connector 1 in the first embodiment, the first elastic portions 42 are curved relative to the wide width portions 43 of the connection terminals 4 in the direction opposite to that of the second elastic portions 44. Further, the angle between the wide width portion 43 and the first elastic portion 42 or the angle between the wide width portion 43 and the second elastic portion 44 becomes an acute angle (the angle θ1 and the angle θ2). In other words, the first elastic portion 42, the wide width portion 43, and the second elastic portion 44 are arranged to form the substantially Z character shape. Accordingly, it is possible to minimize a distance D (a shift in the front-rear direction) between an extension line S (refer to a projected line shown in FIG. 5) from a position where each of the connecting portions 41 is held with the fixed housing 2 toward the vertical upside and a position where each of the terminal portions 45 is held (tightly fitted in) with the movable housing 3.

With the configuration described above, it is possible to minimize an offset amount, and to prevent each of the first elastic portions 42 and each of the second elastic portions 44 from being excessively deformed when the movable housing 3 is moved. As a result, it is possible to smoothly move the movable housing 3 relative to the fixed housing 2, especially in the front-rear direction (the curved directions of the first elastic portion 42 and the second elastic portion 44). Further, with the configuration of the power source terminals 5 similar to that of the connection terminals 4, it is possible to smoothly move the movable housing 3 relative to the fixed housing 2 in the front-rear direction.

In the first embodiment, it should be noted that the number of the connection terminals 4 or the power source terminals 5 is arbitrary. Similarly, the number of the first power source side elastic portions 52, the power source side wide width portions 53, or the second power source side elastic portions 54 of the power source terminals 5 is also arbitrary. Further, as described above, the first power source side elastic portions 52 have the width in the left-right direction the same as that of the second power source side elastic portions 54. Alternatively, the first power source side elastic portions 52 may have a width in the left-right direction different from that of the second power source side elastic portions 54. Similarly, as described above, all of the power source side wide width portions 53 have the identical width in the left-right direction. Alternatively, the power source side wide width portions 53 may have a width in the left-right direction different from each other. Further, the angle θ1 between the wide width portion 43 and the first elastic portion 42 or the angle θ2 between the wide width portion 43 and the second elastic portion 44 are set to the right angle. It should be noted that, when the angle θ1 and the angle θ2 are set to an acute angle, it is possible to smoothly move the movable housing 3 more effectively.

Further, in the first embodiment, as described above, the electrical connector 1 is mounted on the board B1 in the standing posture. Alternatively, the electrical connector 1 may be mounted on the board B1 in a lateral posture, so that the electrical connector 1 is connected to the mating side connector 100 in a direction parallel to the board B1. In this case, the extending wall portions 12 (the parallel portions 12*b*) paired in the left-right direction and disposed one side of the fixed housing 2 in the front-rear direction are to abut against the board B1. Further, the connecting portions 41 of the connection terminals 4 (the board mounting portions 41*a*) and the power source side connecting portions 51 of the power source terminals 5 (the power source side board mounting portions 51*a*) are extended toward the board B1 to be fixed with solder.

Second Embodiment

Figure 8:
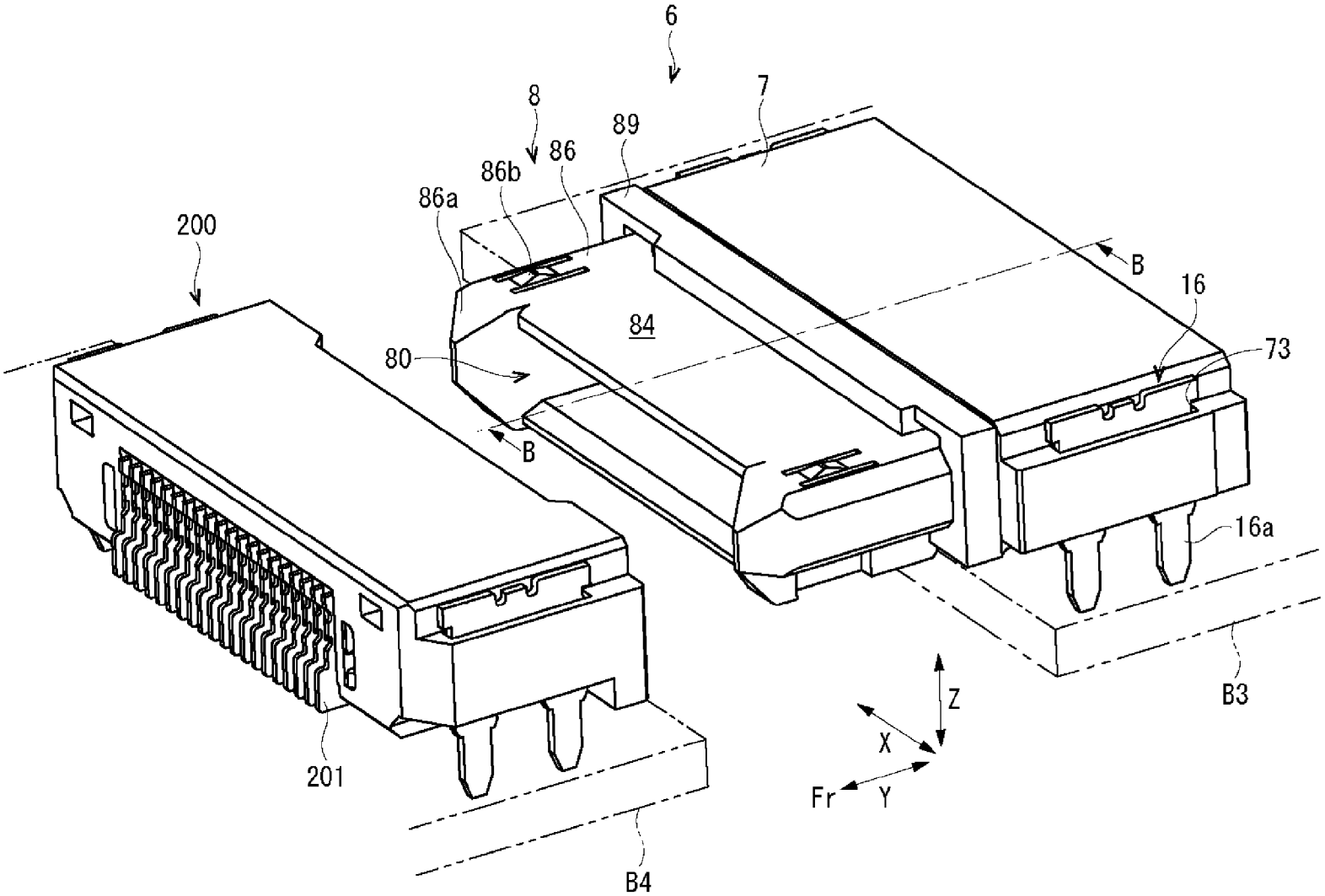
FIG. 8 is a perspective views showing an electrical connector and a mating side connector according to a second embodiment of the present invention.
Figure 9:
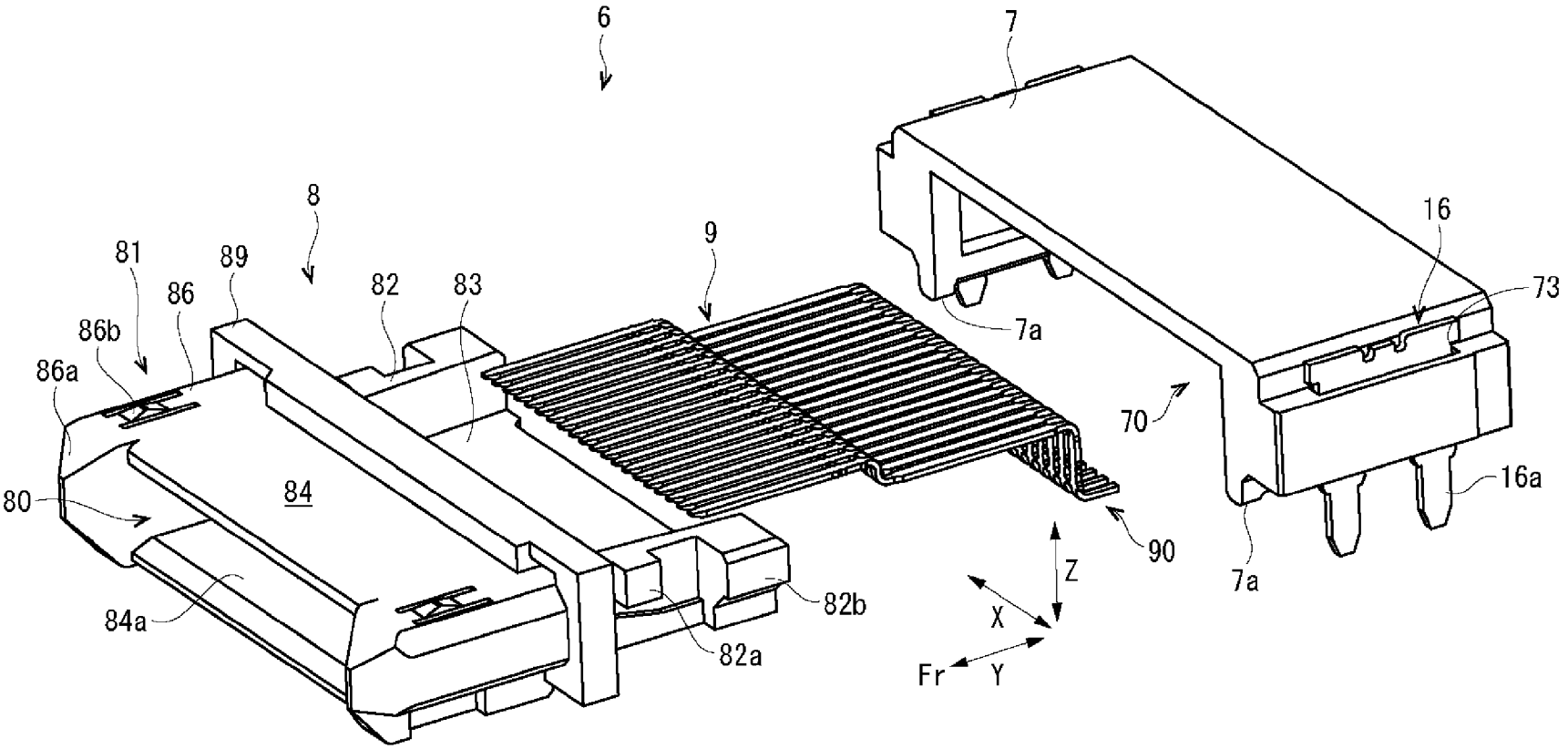
FIG. 9 is an exploded perspective view showing the electrical connector according to the second embodiment of the present invention.
Figure 10:
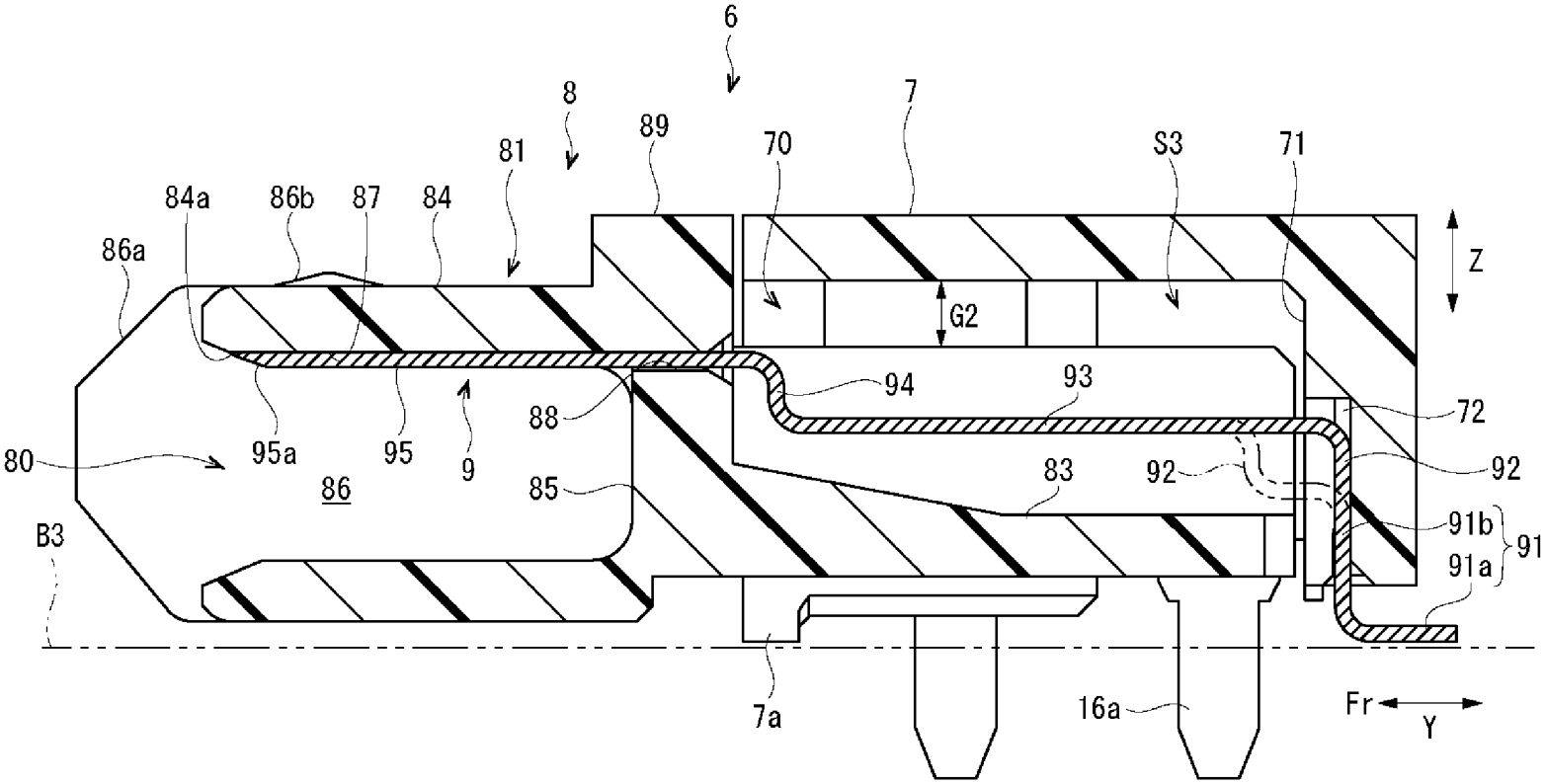
FIG. 10 is a sectional view showing the electrical connector taken along a line B-B in FIG. 8 according to the second embodiment of the present invention.

A second embodiment of the present invention will be explained next with reference to FIGS. 8 to 10. FIG. 8 is a perspective views showing an electrical connector 6 and a mating side connector 200 according to the second embodiment of the present invention. FIG. 9 is an exploded perspective view showing the electrical connector 6 according to the second embodiment of the present invention. FIG. 10 is a sectional view showing the electrical connector 6 taken along a line B-B in FIG. 8 according to the second embodiment of the present invention. In the following description, explanations of components of the electrical connector 6 similar to those of the electrical connector 1 are omitted as necessary. Further, components of the electrical connector 6 similar to those of the electrical connector 1 are designated with the same reference numerals.

As shown in FIG. 8, the electrical connector 6 is a plug (a meal type) to be attached to a board B3. The mating side connector 200 as a receptacle (a female type) is attached to a mating side board B4. When the electrical connector 6 is connected to the mating side connector 200, a pair of the board B3 and the mating side board B4 is electrically connected.

As shown in FIG. 9, the electrical connector 6 includes a fixed housing 7; a movable housing 8; and a plurality of connection terminals 9.

In the second embodiment, the electrical connector 6 is integrally formed of an insulation material such as a synthetic resin and the like, and is formed in a substantially rectangular box shape elongating in the left-right direction. Further, the electrical connector 6 includes a fixed side opening portion 70 opening a lower side and a front side thereof. The fixed side opening portion 70 is formed such that the movable housing 8 can be retained in the fixed side opening portion 70 with a specific space G2 relative to an outer side surface of the movable housing 8.

As shown in FIG. 10, a plurality of fixed side pressing grooves 72 is formed in a rear side surface of a fixed side inner surface 71 constituting a part of the fixed side opening portion 70 such that the fixed side pressing grooves 72 extend upwardly from a lower edge. The fixed side pressing grooves 72 are arranged with an equal interval in between in the left-right direction. Further, each of the fixed side pressing grooves 72 has a C character shaped sectional surface in a plan view.

As shown in FIG. 9, the fixed housing 7 includes a protruding portion on both left and right side outer side surfaces except an upper portion thereof such that the protruding portion protrudes stepwise outwardly. A metal member fixing hole 73 is formed to penetrate each of the protruding portions, and the metal member fixing hole 73 has a substantially rectangular shape, so that the fixing metal member 16 is tightly fitted into the metal member fixing hole 73. A pair of contact surface portions 7*a* arranged in the left-right direction is formed on a front edge lower portion of the fixed housing 7 for abutting against the board B3.

In the second embodiment, the movable housing 8 is integrally formed with an insulation material such as a synthetic resin and the like. Further, the movable housing 8 includes a movable main body portion 81; a pair of movable leg portions 82 arranged in the left-right direction; and a movable plate portion 83. The movable main body portion 81 includes a movable side opening portion 80 opening on a front side thereof, and is formed in a substantially rectangular cylindrical shape. The movable leg portions 82 are formed to extend backwardly from both left and right edge portions of the movable main body portion 81 in the left-right direction. The movable plate portion 83 is formed to connect the movable leg portions 82 paired in the left-right direction. With the movable main body portion 81 and the movable leg portions 82, the movable housing 8 is formed in a substantially U character shape in the plan view.

In the second embodiment, the movable side opening portion 80 is formed in a substantially cubic shape elongating in the left-right direction in the front view. Further, the movable side opening portion 80 is arranged to accommodate a plurality of mating side terminals 201 of the mating side connector 200.

In the second embodiment, the movable main body portion 81 includes a pair of movable main body wall portions 84 arranged in the front-rear direction with the movable side opening portion 80 in between; a movable bottom portion 85 arranged to connect rear portions of the movable main body wall portions 84 facing in the up-down direction; and a pair of movable column portions 86 arranged in the left-right direction and formed to support left and right outer edge portions of the movable main body wall portions 84 and the movable bottom portion 85.

In the second embodiment, each of the movable main body wall portions 84 is formed in a substantially rectangular shape elongating in the left-right direction in the plan view. As shown in FIG. 10, a plurality of movable side pressing grooves 87 is formed as a recess portion in a movable side inner wall surface 84*a* of each of the movable main body wall portions 84 at an upper portion thereof constituting a part of the movable side opening portion 80. Each of the movable side pressing grooves 87 is formed to extend in the up-down direction, and is situated at a location corresponding to each of the fixed side pressing grooves 72, respectively. Further, each of the movable side pressing grooves 87 is formed in a groove shape having a substantially U character shape in the front view, and is formed to extend from a rear edge portion to near an upper edge portion of each of the movable main body wall portions 84.

In the second embodiment, the movable bottom portion 85 is formed in a substantially cubic shape elongating in the left-right direction, so that the movable bottom portion 85 constitutes a bottom surface of the movable side opening portion 80. A plurality of terminal through holes 88 penetrating in the front-rear direction is formed in the movable bottom portion 24 at locations corresponding to each of the movable side pressing grooves 87.

As shown in FIG. 9, each of the movable column portions 86 is formed in a substantially rectangular column shape. An engaging guide portion 86*a* is formed at an upper edge portion of each of the movable column portions 86. Further, a lock portion 86*b* is formed on an upper surface of each of the movable column portions 86 for connecting and fixing the mating side connector 200. Further, a flange portion 89 is formed at a rear edge portion of the movable main body portion 81 such that the flange portion 89 extends from the movable main body portion 81 and a surface of each of the movable column portions 86.

In the second embodiment, each of the movable leg portions 82 is integrally formed to extend backwardly from the lower edge of each of the movable column portions 86. An engaging block 82*b* having a substantially cubic shape is disposed at a rear edge portion of each of the movable leg portions 82 such that the engaging block 82*b* protrudes from an outer side surface of each of the movable leg portions 82 in the left-right direction.

In the second embodiment, the movable plate portion 83 is disposed between the movable leg portions 82 paired in the left-right direction, and is connected to each of the movable leg portions 82 and a lower portion of the movable bottom portion 85. An upper surface of the movable plate portion 83 is inclined upwardly from a substantially center portion thereof in the front-rear direction toward a front side thereof (refer to FIG. 10).

As shown in FIG. 9, a plurality of the connection terminals 9 constitutes a terminal row 90 arranged linearly with an equal interval in between in the left-right direction. In the second embodiment, each of the connection terminals 9 has an identical configuration. Accordingly, in the following description, the configuration of one of the connection terminals 9 will be explained with reference to FIGS. 10 and 11.

Figure 11:
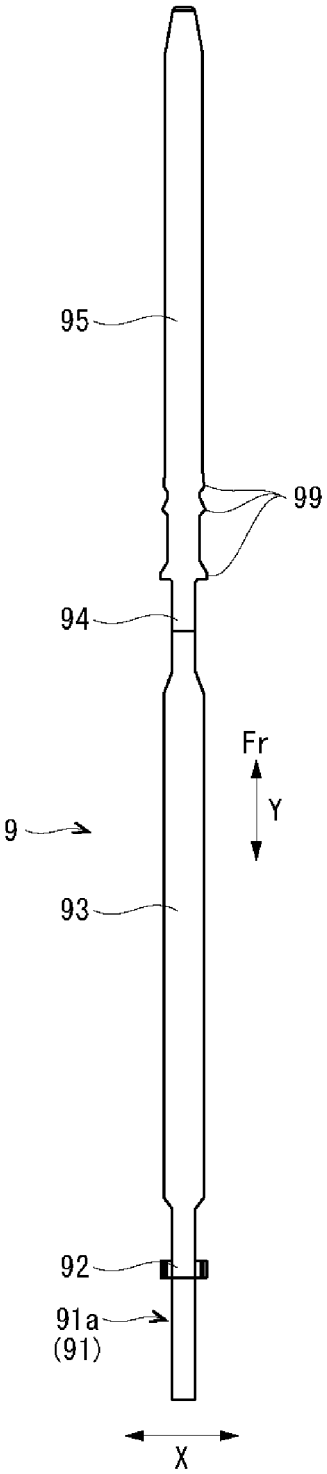
FIGS. 11(*a*) and 11(*b*) are views showing a connection terminal of the electrical connector according to the second embodiment of the present invention, wherein FIG. 11(*a*) is a plan view showing the connection terminal, and FIG. 11(*b*) is a side view showing the connection terminal.
Figure 11:
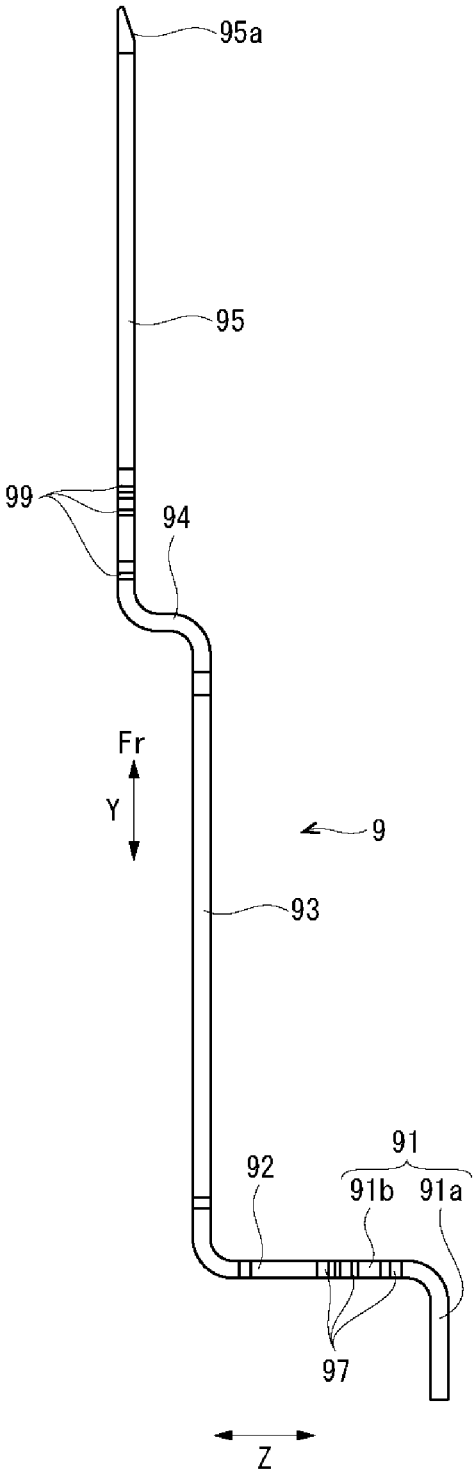

FIGS. 11(*a*) and 11(*b*) are views showing the connection terminal 9 of the electrical connector 6 according to the second embodiment of the present invention. More specifically, FIG. 11(*a*) is a plan view showing the connection terminal 9, and FIG. 11(*b*) is a side view showing the connection terminal 9.

In the second embodiment, each of the connection terminals 9 has the configuration similar to each of the connection terminals 4 in the first embodiment. More specifically, the connection terminal 9 includes a connecting portion 91; a first elastic portion 92; a wide width portion 93; a second elastic portion 94; a terminal portion 95 integrally formed in this order from the rear side to the front side thereof.

In the second embodiment, the connecting portion 91 includes a board mounting portion 91*a* to be electrically connected to the board B3 with solder and the like, and a connection side pressing portion 91*b* extending upwardly from an inner edge portion (the board B1) of the board mounting portion 91*a*.

In the second embodiment, the board mounting portion 91*a* is formed to extend in parallel to the board B3. The connection side pressing portion 91*b* is formed to bend perpendicular to the board mounting portion 91*a*. Further, the connection side pressing portion 91*b* is arranged to be fitted into one of the fixed side pressing grooves 72 formed in the fixed side inner wall surface 71 (refer to FIG. 10). Similar to connection side pressing portion 91*b* in the first embodiment, three pairs of connection side pressing protrusions 97 paired in the left-right direction are disposed on both side surfaces of the connection side pressing portion 91*b*, and the connection side pressing protrusions 47 are arranged with a specific interval in the up-down direction. The connection side pressing portion 91*b* has a length in the up-down direction substantially the same as that of each of the fixed side pressing grooves 72 in the up-down direction. When the connection side pressing portion 91*b* is fitted into one of the fixed side pressing grooves 72, a rear edge portion of the board mounting portion 91*a* is exposed at the rear side of the fixed housing 7.

In the second embodiment, the first elastic portion 92 is formed to slightly extend upwardly from an upper edge portion of the connection side pressing portion 91*b*, so that the first elastic portion 92 is capable of elastically deforming.

In the second embodiment, the wide width portion 93 is formed to bend perpendicular to the first elastic portion 92. Further, the wide width portion 93 is formed to extend toward the front side from an inner edge portion of the first elastic portion 92 and in parallel to the board B1. Further, the wide width portion 93 has a length in the front-rear direction substantially the same as a length of the fixed housing 7 in the front-rear direction.

In the second embodiment, the second elastic portion 94 is formed to bend perpendicular to the wide width portion 93. Further, the second elastic portion 94 is formed to extend upwardly from a front edge portion (one side edge portion) of the wide width portion 93, so that the second elastic portion 94 is capable of elastically deforming. Further, the second elastic portion 94 has a length in the up-down direction substantially the same as a thickness of each of the movable main body wall portions 84.

Accordingly, in the second embodiment, in the connection terminal 9, the connecting portion 91 has a width in the left-right direction the same as that of the second elastic portion 94, and the first elastic portion 92 has a width in the left-right direction the same as that of the second elastic portion 94. Further, the wide width portion 93 has a width in the left-right direction the same as a width of the terminal portion 95 in the left-right direction. In other words, the wide width portion 93 has the width in the left-right direction greater than that of the first elastic portion 92 and the second elastic portion 94 in the left-right direction (the parallel arrangement direction).

In the second embodiment, the terminal portion 95 is formed to bend perpendicular to the second elastic portion 94. Further, the terminal portion 95 is formed to extend upwardly from an upper edge portion (one side) of the second elastic portion 94, so that the terminal portion 95 extends substantially in parallel to the board B3. Further, the terminal portion 95 is configured to be fitted into one of the movable side pressing grooves 87 formed in the movable side inner wall surface 84*a* (refer to FIG. 10).

In the second embodiment, similar to the terminal portions 45 in the first embodiment, three pairs of terminal side pressing protrusions 99 paired in the left-right direction are disposed on both side surfaces of the terminal portion 95. A tapered portion 95*b* is disposed at a front edge portion of the terminal portion 95 such that three sides except an outside of the tapered portion 95*b* are chamfered.

In the second embodiment, each of the connecting portion 91, the first elastic portion 92, the wide width portion 93, the second elastic portion 94, and the terminal portion 95 constituting each of the connection terminals 9 has a length in the extension direction thereof that can be arbitrarily defined according to the length of each of the fixed side pressing grooves 72 and each of the movable side pressing grooves 87, the thickness of the fixed housing 7 and the movable housing 8, and the like.

An operation of assembling the electrical connector 6 will be explained next with reference to FIGS. 9 and 10.

First, the connection terminals 9 are fixed to the movable housing 8. More specifically, a user of the electrical connector 6 attaches the movable housing 8 and the connection terminals 9 to a fixing jig (not shown) such that the connection terminals 9 arranged with an identical interval in between face the specific locations disposed at the rear portion of the movable housing 8. In the next step, the terminal portion 95 of each of the connection terminals 9 is inserted toward the front side into each of the terminal through holes 88 (each of the movable side pressing grooves 87). It should be noted that the operation of attaching the terminal portion 95 of each of the connection terminals 9 to the movable housing 8 is performed using an attachment jig similar to that of the electrical connector 1 in the first embodiment. When the terminal side pressing protrusions 99 of the terminal portion 95 are tightly fitted into each of the movable side pressing grooves 87, the terminal portion 95 is held in a state that the terminal portion 95 does not come off.

In the next step, after the terminal row 90 is fixed to the movable housing 8, the movable housing 8 is supported on the fixed housing 7. More specifically, the user of the electrical connector 6 attaches the fixed housing 7 and the movable housing 8 to a fixing jig (not shown) such that the movable housing 8 faces the specific location disposed at the lower portion of the fixed housing 7. Then, the user moves the movable housing 8 upwardly from the lower edge of the fixed side opening portion 70, so that each of the connecting portions 91 (the connection side pressing portion 91*b*) is inserted into each of the fixed side pressing grooves 72. It should be noted that, similar to the operation in the first embodiment, the operation of inserting the movable housing 8 into the fixed side opening portion 70 is performed using the attachment jig. When the connection side pressing protrusions 97 of each of connection side pressing portions 91*b* are pressed into each of the fixed side pressing grooves 72, each of the connecting portions 91 is held in a state that each of the connecting portions 91 does not come off.

Through the operation described above, the electrical connector 6 is fully assembled. After the electrical connector 6 is assembled, the electrical connector 6 is placed on the board B3. Afterward, the board mounting portion 91*a* of each of the connection terminals 9 and the metal member leg portions 16*a* of each of the fixing metal members 16 are fixed to the board B3 with solder.

In the second embodiment, when the electrical connector 6 is fully assembled, the fixed housing 7 and the movable housing 8 are arranged in parallel to the board B3. Further, the movable main body portion 81 of the movable housing 8 is situated in front of a front edge surface of the fixed housing 7. Further, in this state, the contact surface portion 7*a* of each of the fixed housing 7 abuts against the board B3, and a small space is created between the lower edge surface of the fixed housing 7 at the rear portion thereof and the board mounting portion 91*a* of each of the connecting portions 91. More specifically, when the electrical connector 6 is mounted on the board B3, the fixed housing 7 is fixed at a position where the fixed housing 7 is slightly floated from the board B3 through each of the connection terminals 9. Further, the movable housing 8 is supported at a position where the movable housing 8 is slightly floated from the board B3.

Further, in the second embodiment, when the electrical connector 6 is fully assembled, each of the connection terminals 9 bridges between the fixed housing 7 and the movable housing 8. Further, each of the first elastic portions 92, each of the wide width portions 93, and each of the second elastic portions 94 become exposed portions contacting with air in the fixed side opening portion 70. Further, a space is created between each of the first elastic portions 92 arranged adjacently, and between each of the second elastic portions 94 arranged adjacently.

In the electrical connector 6 in the second embodiment, as described above, each of the first elastic portions 92 and each of the second elastic portions 94 are capable of elastically deforming, so that the movable housing 8 can move in the front-rear direction and the left-right direction relative to the fixed housing 7. More specifically, a stress is concentrated on the curved portion between each of the first elastic portions 92 and each of the wide width portions 93. Accordingly, mainly the curved portions elastically deform. Similarly, mainly the curved portion between each of the wide width portions 93 and each of the first elastic portions 92, and the curved portion between each of the first elastic portions 92 and the terminal portion 95 elastically deform. As a result, the movable housing 8 of the electrical connector 6 is supported with the connection terminals 9 such that the movable housing 8 is capable of moving in the up-down direction and the left-right direction in the fixed side opening portion 70 of the fixed housing 7.

Similar to the electrical connector 1 in the first embodiment, in the electrical connector 6 in the second embodiment, the movable leg portions 82 of the movable housing 8 paired in the left-right direction are disposed within both left and right edge regions of the fixed side opening portion 70 with the space G2 in between (refer to FIG. 10). Further, each of the engaging blocks 82*b* formed on each of the movable leg portions 82 is loosely fitted in the engaging space S3 (refer to FIG. 10) formed inside the fixed side opening portion 70 (the both side surfaces of the fixed housing 7 in the left-right direction). Accordingly, the movable housing 8 does not come off toward the front side from the fixed housing 7.

In the second embodiment, the electrical connector 6 is fitted into the mating side connector 200, so that the electrical connector 6 is electrically connected to the mating side connector 200. It should be noted that the configuration of the mating side connector 200 and the operation of connecting the electrical connector 6 to the mating side connector 200 are similar to those in the first embodiment, and explanations thereof are omitted.

In the electrical connector 6 in the second embodiment, it is possible to obtain an effect similar to that of the electrical connector 1 in the first embodiment. More specifically, it is possible to easily match impedance at least one of between each of the connection terminals 9 or between the connection terminals 9 arranged adjacently. Therefore, it is possible to properly transmit the high frequency signal at a high speed. Further, the first elastic portions 92 and the second elastic portions 94 are capable of flexibly and elastically deforming. Accordingly, the movable housing 8 is capable of smoothly moving or shifting relative to the fixed housing 7. It should be noted that the number of the connection terminals 9 is arbitrary.

In the second embodiment, the first elastic portion 92 of each of the connection terminals 9 may be formed in a substantially L character shape in the side view as indicated with a phantom line in FIG. 10, so that the connecting portions 91 and the first elastic portions 92 are curved.

As described above, in the electrical connector 6 in the second embodiment, the wide width portion 93 of each of the connection terminals 9 is formed to extend substantially in parallel to the board B3, and the present invention is not limited to the configuration. Alternatively, similar to the wide width portions 43 of the connection terminals 4 in the first embodiment, the wide width portion 93 of each of the connection terminals 9 may be inclined (not shown). In this case, it is preferred that the wide width portion 93 of each of the connection terminals 9 is inclined downwardly from the upper edge portion of the first elastic portion 92, and extends toward the front side (one side). In other words, it is preferred that an angle between the wide width portion 93 and the first elastic portion 92 and an angle between the wide width portion 93 and the second elastic portion 94 become an acute angle (less than 90°), respectively.

In the second embodiment, similar to the connection terminals 4 in the first embodiment, the first elastic portion 92, the wide width portion 93, and the second elastic portions 94 are arranged to form the substantially Z character shape. Accordingly, it is possible to minimize a distance (a shift) between an extension line extending horizontally from a position where each of the connecting portions 41 is held with the fixed housing 7 toward the front side (in the connecting direction of the mating side connector 200) and a position where each of the terminal portions 95 is tightly fitted in the movable housing 8. With the configuration described above, it is possible to further smoothly move the movable housing 8 relative to the fixed housing 7 in the up-down direction (the direction connecting inside and outside).

In the first and second embodiments described above, the electrical connector 1 and the electrical connector 6 are explained as the preferred embodiments of the present invention, including various preferred technical features. It should be noted that the technical scope of the present invention is not limited to the features unless the description limiting to the features exists. Further, it should be noted that the components in the embodiments may be modified or replaced with existing components, or the configurations may include existing components.

The disclosure of Japanese Patent Applications No. 2013-166099, filed on Aug. 9, 2013, is incorporated in the application by reference.

While the present invention has been explained with reference to the specific embodiments of the present invention, the explanation is illustrative and the present invention is limited only by the appended claims.

What is claimed is:

1. An electrical connector to be connected to a mating side connector in a connecting direction, comprising:

a fixed housing to be fixed to a board;

a movable housing arranged to be movable relative to the fixed housing; and a plurality of terminals disposed between the fixed housing and the movable housing, and arranged with a specific interval in between, wherein each of said terminals includes:

a connecting portion held with the fixed housing and to be fixed to the board;

a first elastic portion connected to the connecting portion and capable of elastically deforming;

a terminal portion held with the movable housing and to be electrically connected to the mating side connector;

a second elastic portion connected to the terminal portion and capable of elastically deforming; and a wide width portion connected between the first elastic portion and the second elastic portion so that the first elastic portion is curved in a direction opposite to a direction that the second elastic portion is curved, said wide width portion is formed in a straight flat plate shape, said wide width portion has a width greater than that of the first elastic portion and the second elastic portion, said terminal portion extends in the connecting direction, and said wide width portion is inclined relative to the terminal portion.

2. The electrical connector according to claim 1, wherein said wide width portion is inclined by an acute angle relative to the first elastic portion and the second elastic portion, and said wide width portion extends toward a connection direction with the mating side connector.

3. The electrical connector according to claim 1, wherein said fixed housing includes a fixed side opening portion for accommodating the movable housing so that the movable housing is retained in the fixed side opening portion with a specific space between an outer side surface of the movable housing and the fixed housing, said movable housing includes a movable side opening portion situated above the fixed housing for inserting the mating side connector from above, said connecting portion is to extend upwardly from the board, and is fitted in a fixed side pressing groove formed in a fixed side inner wall surface constituting the fixed side opening portion, said first elastic portion extends toward inside from an upper edge portion of the connecting portion, said wide width portion is inclined toward outside from an inner edge portion of the first elastic portion, and extends upwardly, said second elastic portion extends toward inside from an upper edge portion of the wide width portion, and said terminal portion extends upwardly from an inner edge portion of the second elastic portion, and is fitted in a movable side pressing groove formed in a movable side inner wall surface constituting the movable side opening portion or a movable side outer wall surface of the movable housing.

4. The electrical connector according to claim 1, wherein said fixed housing includes a fixed side opening portion for accommodating the movable housing so that the movable housing is retained in the fixed side opening portion with a specific space between an outer side surface of the movable housing and the fixed housing, said movable housing includes a movable side opening portion situated on one side of the fixed housing in parallel to the board for inserting the mating side connector from one side, said connecting portion is to extend upwardly from the board, and is fitted in a fixed side pressing groove formed in a fixed side inner wall surface constituting the fixed side opening portion, said first elastic portion extends upwardly from an upper edge portion of the connecting portion, said wide width portion is inclined downwardly from an upper edge portion of the first elastic portion, and extends one side, said second elastic portion extends upwardly from one side edge portion of the wide width portion, and said terminal portion extends one side from an inner edge portion of the second elastic portion, and is fitted in a movable side pressing groove formed in a movable side inner wall surface constituting the movable side opening portion.

5. An electrical connector to be connected to a mating side connector in a connecting direction, comprising:

a fixed housing to be fixed to a board;

a movable housing arranged to be movable relative to the fixed housing; and a plurality of terminals disposed between the fixed housing and the movable housing, wherein each of said terminals includes:

a connecting portion held with the fixed housing and to be fixed to the board;

a plurality of first elastic portions connected to the connecting portion in an arrange state with a specific interval in between and capable of elastically deforming;

a terminal portion held with the movable housing and to be electrically connected to the mating side connector;

a plurality of second elastic portions connected to the terminal portion in an arrange state with a specific interval in between and capable of elastically deforming; and a plurality of wide width portions connected between the first elastic portions and the second elastic portions so that the first elastic portions are curved in a direction opposite to a direction that the second elastic portions are curved, said wide width portions are formed in a straight flat plate shape, said wide width portions have a width greater than that of the first elastic portions and the second elastic portions, said terminal portion extends in the connecting direction, and said wide width portion is inclined relative to the terminal portion.

6. The electrical connector according to claim 5, wherein said wide width portion is inclined by an acute angle relative to the first elastic portion and the second elastic portion, and said wide width portion extends toward a connection direction with the mating side connector.

7. The electrical connector according to claim 5, wherein said fixed housing includes a fixed side opening portion for accommodating the movable housing so that the movable housing is retained in the fixed side opening portion with a specific space between an outer side surface of the movable housing and the fixed housing, said movable housing includes a movable side opening portion situated above the fixed housing for inserting the mating side connector from above, said connecting portion is to extend upwardly from the board, and is fitted in a fixed side pressing groove formed in a fixed side inner wall surface constituting the fixed side opening portion, said first elastic portion extends toward inside from an upper edge portion of the connecting portion, said wide width portion is inclined toward outside from an inner edge portion of the first elastic portion, and extends upwardly, said second elastic portion extends toward inside from an upper edge portion of the wide width portion, and said terminal portion extends upwardly from an inner edge portion of the second elastic portion, and is fitted in a movable side pressing groove formed in a movable side inner wall surface constituting the movable side opening portion or a movable side outer wall surface of the movable housing.

8. The electrical connector according to claim 5, wherein said fixed housing includes a fixed side opening portion for accommodating the movable housing so that the movable housing is retained in the fixed side opening portion with a specific space between an outer side surface of the movable housing and the fixed housing, said movable housing includes a movable side opening portion situated on one side of the fixed housing in parallel to the board for inserting the mating side connector from one side, said connecting portion is to extend upwardly from the board, and is fitted in a fixed side pressing groove formed in a fixed side inner wall surface constituting the fixed side opening portion, said first elastic portion extends upwardly from an upper edge portion of the connecting portion, said wide width portion is inclined downwardly from an upper edge portion of the first elastic portion, and extends one side, said second elastic portion extends upwardly from one side edge portion of the wide width portion, and said terminal portion extends one side from an inner edge portion of the second elastic portion, and is fitted in a movable side pressing groove formed in a movable side inner wall surface constituting the movable side opening portion.

9. An electrical connector to be connected to a mating side connector, comprising:

a fixed housing to be fixed to a board;

a movable housing arranged to be movable relative to the fixed housing; and a plurality of terminals disposed between the fixed housing and the movable housing, and arranged with a specific interval in between, wherein each of said terminals includes:

a connecting portion held with the fixed housing and to be fixed to the board;

a first elastic portion connected to the connecting portion and capable of elastically deforming;

a terminal portion held with the movable housing and to be electrically connected to the mating side connector;

a second elastic portion connected to the terminal portion and capable of elastically deforming; and a wide width portion connected between the first elastic portion and the second elastic portion so that the first elastic portion is curved in a direction opposite to a direction that the second elastic portion is curved, said wide width portion has a width greater than that of the first elastic portion and the second elastic portion, said fixed housing includes a fixed side opening portion for accommodating the movable housing so that the movable housing is retained in the fixed side opening portion with a specific space between an outer side surface of the movable housing and the fixed housing, said movable housing includes a movable side opening portion situated above the fixed housing for inserting the mating side connector from above, said connecting portion is to extend upwardly from the board, and is fitted in a fixed side pressing groove formed in a fixed side inner wall surface constituting the fixed side opening portion, said first elastic portion extends toward inside from an upper edge portion of the connecting portion, said wide width portion extends upwardly from an inner edge portion of the first elastic portion, said second elastic portion extends toward inside from an upper edge portion of the wide width portion, and said terminal portion extends upwardly from an inner edge portion of the second elastic portion, and is fitted in a movable side pressing groove formed in a movable side inner wall surface constituting the movable side opening portion or a movable side outer wall surface of the movable housing.

10. The electrical connector according to claim 9, wherein said wide width portion is formed in a straight flat plate shape.

11. An electrical connector to be connected to a mating side connector, comprising:

a fixed housing to be fixed to a board;

a movable housing arranged to be movable relative to the fixed housing; and a plurality of terminals disposed between the fixed housing and the movable housing, and arranged with a specific interval in between, wherein each of said terminals includes:

a connecting portion held with the fixed housing and to be fixed to the board;

a first elastic portion connected to the connecting portion and capable of elastically deforming;

a terminal portion held with the movable housing and to be electrically connected to the mating side connector;

a second elastic portion connected to the terminal portion and capable of elastically deforming; and a wide width portion connected between the first elastic portion and the second elastic portion so that the first elastic portion is curved in a direction opposite to a direction that the second elastic portion is curved, said wide width portion has a width greater than that of the first elastic portion and the second elastic portion, said fixed housing includes a fixed side opening portion for accommodating the movable housing so that the movable housing is retained in the fixed side opening portion with a specific space between an outer side surface of the movable housing and the fixed housing, said movable housing includes a movable side opening portion situated on one side of the fixed housing in apparel to the board for inserting the mating side connector from one side, said connecting portion is to extend upwardly from the board, and is fitted in a fixed side pressing groove formed in a fixed side inner wall surface constituting the fixed side opening portion, said first elastic portion extends upwardly from an upper edge portion of the connecting portion, said wide width portion extends toward one side from an inner edge portion of the first elastic portion, said second elastic portion extends upwardly from a one side edge portion of the wide width portion, and said terminal portion extends toward one side from an inner edge portion of the second elastic portion, and is fitted in a movable side pressing groove formed in a movable side inner wall surface constituting the movable side opening portion.

12. The electrical connector according to claim 11, wherein said wide width portion is formed in a straight flat plate shape.

* * * * *